US006854843B2

(12) United States Patent
Anami et al.

(10) Patent No.: US 6,854,843 B2
(45) Date of Patent: Feb. 15, 2005

(54) RECORDING APPARATUS

(75) Inventors: Akira Anami, Nagano-ken (JP); Takayuki Shiota, Nagano-ken (JP); Mamoru Ukita, Nagano-ken (JP); Narihiro Oki, Nagano-ken (JP); Satoshi Nakata, Nagano-ken (JP); Kazuo Otsuka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/642,311

(22) Filed: Aug. 14, 2003

(65) Prior Publication Data

US 2004/0066444 A1 Apr. 8, 2004

(30) Foreign Application Priority Data

Aug. 14, 2002 (JP) ..... 2002-236402
Jun. 19, 2003 (JP) ..... 2003-175058

(51) Int. Cl.[7] ..... B41J 2/01; B41J 13/00; B65H 5/00

(52) U.S. Cl. ..... 347/104; 400/625; 271/273

(58) Field of Search ..... 347/104; 271/81, 271/273; 400/625

(56) References Cited

U.S. PATENT DOCUMENTS 5,731,829 A * 3/1998 Saito et al. ..... 347/104
5,818,487 A * 10/1998 Yoshimura et al. ..... 347/104
5,870,127 A * 2/1999 Koike et al. ..... 347/104
6,152,561 A * 11/2000 Watanabe ..... 347/104
6,619,796 B2 * 9/2003 Rasmussen et al. ..... 347/104

FOREIGN PATENT DOCUMENTS

| | | | |
|---|---|---|---|
| EP | 0 620 118 A2 | 10/1994 | ..... B41J/11/48 |
| JP | 2002-192782 | 7/2002 | |
| WO | WO 02/01493 A2 | 1/2002 | ..... G06K/13/08 |

OTHER PUBLICATIONS

European Search Report dated Dec. 9, 2003.

* cited by examiner

*Primary Examiner*—Daniel J. Colilla
*Assistant Examiner*—Jill E. Culler
(74) *Attorney, Agent, or Firm*—John J. Penny, Jr.; Edwards & Angell, LLP

(57) ABSTRACT

A recording apparatus has a recording medium feeding mechanism for feeding a recording medium by one at a time, a recording head for performing recording, a discharging roller having a discharging driven roller and a discharge driving roller and a recording medium stacker capable of being changed to a first position in which recording is performed on a hard recording medium and a second position in which recording is performed on a recording medium fed by the recording medium feeding mechanism, wherein the discharging driven roller is in contact with the discharge driving roller in case the recording medium stacker is in second position, and the discharging driven roller is separated from a recording medium transfer path in case the recording medium stacker is in first position.

13 Claims, 15 Drawing Sheets

RECORDING APPARATUS

The present application claims priority from Japanese Patent Applications Nos. 2002-236402 filed on Aug. 14, 2002 and 2003-175058 filed on Jun. 19, 2003, the contents of which are incorporated herewith for a reference.

BACKGROUND OF THE INVENTION

1. Field of the Invention

The present invention relates to a recording apparatus such as an inkjet printer for recording by ejecting ink droplets on a recording medium such as recordable papers, further a liquid ejection apparatus for applying liquids to a medium.

Here, the liquid ejection apparatus is not limited to such recording apparatuses as a printer, a copier and a facsimile, which perform recording by ejecting ink droplets from an inkjet type recording head on a recording medium, and includes an apparatus applying liquids to a medium by ejecting liquids, which correspond to the use of ink to replace it, from a liquid ejection head equivalent to the recording head or print head. As the liquid ejection head, in addition to the recording head, a color material ejection head used for manufacturing a color filter such as a liquid crystal display, an electrode material (conduction paste) ejection head used for forming electrodes such as an organic EL display or a field emission display (FED), a living organism ejection head used for manufacturing a bio chip and a sample ejection head for a minute pipette etc. are taken.

2. Description of the Related Art

As one of the recording apparatus and the liquid ejection apparatus, there has been known an inkjet printer. The inkjet printer has a recording medium feeding mechanism, provided in the upstream of the transfer path for the recording medium, for feeding the recording medium (e.g. normal papers, postcards, envelopes), which axe stacked and held in slant position, to the downstream side one at a time, a recording head, provided downstream of the recording medium feeding mechanism, for recording by ejecting ink droplets toward the recording medium and a paper discharging roller, provided downstream of the recording head, for discharging the recording medium. The paper discharging roller consists of a paper discharge driving roller provided at the non-recording side of the recording medium (i.e. the back of the materials) and a paper discharging driven roller, provided at the recording side of the recording medium (i.e. the front of the materials). These rollers can be a toothed roller having a plurality of teeth on the circumference thereof.

Meanwhile, the recent inkjet printer is made up to be capable of performing recording on various recording medium such as postcards, envelopes, thick board papers and CD-R (recordable compact disks) in addition to normal papers.

In case of performing recording on materials or medium having flexibility such as normal papers, postcards and envelopes which can be fed while being bent (hereinafter referred to as "papers"), the first medium transfer path is used, wherein the papers are fed in one direction, that is, recording is performed by the recording head while the papers are fed by the record paper feeding mechanism, and then the papers are discharged to a recording medium stacker provided at the front of the apparatus (the downstream of the medium transfer path) by the paper discharging roller. In the meantime, in case of performing recording on materials having hardness such as thick board papers and CD-R (hereinafter referred to as "hard recording medium"), since it is difficult or impossible to feed using the record paper feeding mechanism, the second medium transfer path of straight line is used, wherein the hard recording medium are fed back and forth, that is, recording is performed by feeding the hard recording medium from the recording medium stacker at the front of the apparatus toward the recording head, and then the hard materials are discharged to the recording medium stacker again.

In case of performing recording on for example CD-R using the second medium transfer path, the paper discharging driven roller needs not to be in contact with the CD-R. This is to prevent the contact trace from occurring caused by the contact of the paper discharging driven roller consisting of the toothed roller with the front side of CD-R as the recorded side and prevent the effect on the data memory layer caused by the contact (e.g. data loss in case data is stored or unable to store data in case data is not stored).

For this reason, it has the configuration to maintain the contact state in which the paper discharging driven roller is in contact with the paper discharge driving roller in case of performing recording on papers such as the normal papers by changing the position of a paper discharging frame in which the paper discharging roller is installed, and to maintain the separation state in which the paper discharging driven roller is separated from the recording medium transfer path in case of performing recording on hard recording medium such as the CD-R. In this way, it has been disclosed that the apparatus changes the position of the paper discharging driven roller corresponding to the object of printing as disclosed, for example, in Japanese Patent Application Laid-Open No. 2002-192782.

Moreover, in case of performing recording on hard recording medium such as the CD-R using the second medium transfer path, an operating lever for allowing the paper discharging frame to be in the separation state is additionally provided in the apparatus.

However, during printing on the hard recording medium, operating the operating lever was inconvenient and there was concern that the undesired condition as described above occurred when a user performed printing on the hard recording medium by falsely operating the operating lever.

SUMMARY OF THE INVENTION

Therefore, it is an object of the present invention to provide a recording apparatus and a liquid ejection apparatus, which are capable of overcoming the above drawbacks accompanying the conventional art. The above and other objects can be achieved by combinations described in the independent claims. The dependent claims define further advantageous and exemplary combinations of the present invention.

According to the first aspect of the present invention, a recording apparatus comprises a recording head for ejecting material onto a recording medium; a medium discharging driven roller disposed in a medium transfer path on a recording side of the recording medium; and a recording medium stacker for stacking the recording medium on which recording is performed, said stacker being operably associated with said medium discharging driven roller, and said stacker being operated to change between a first position where said medium discharging driven roller is positioned out of the medium transfer path and a second position where said medium discharging driven roller is positioned within the medium transfer path.

According to the foregoing features, the position of the discharging driven roller can be changed to the corresponding state as the discharging driven roller follows the change movement of the position of the recording medium stacker. Moreover, since the state of the discharging driven roller is set automatically by only operating the recording medium stacker, operations which a user should perform can be decreased.

That is, recording can be performed on various recording medium under proper conditions, because the discharging driven roller is selected to be within or out of the recording medium transfer path, recording medium are carried and recording is performed. Therefore, for example in case of recording medium for which there might be a undesired condition caused by contacting with the discharging driven roller during recording, recording can be performed while contacting with the discharging driven roller is securely prevented, because the discharging driven roller can be positioned out of the recording medium transfer path by allowing the recording medium stacker to be in the first position. Meanwhile, in case of recording medium for which it is desirable that the discharging driven roller be in contact with the discharging driven roller during recording, recording can be performed while the discharging driven roller is firmly in contact with the discharging driven roller, because the discharging driven roller can be positioned within the recording medium transfer path by allowing the recording medium stacker to be in the second position.

According to the second aspect of the present invention, a recording apparatus comprises a recording head for ejecting liquid onto a first and a second recording medium; a medium discharging driven roller disposed in a medium transfer path; and a recording medium stacker operably associated with said medium discharging driven roller, said stacker being operated to change between a first position where recording is performed on the first medium in a non-contact state with said medium discharging driven roller and a second position where recording is performed on the second medium in a contact state with said driven roller.

According to the foregoing structure, in case a first recording medium or a second recording medium is selected as a recording medium, recording can be performed on each of the recording medium under proper conditions. That is, in case the first recording medium is selected as a recording medium, carriage and recording can be performed while the first recording medium is securely maintained not to be in contact with the discharging driven roller, because the discharging driven roller can be positioned out of the recording medium transfer path by allowing the recording medium stacker to be in the first position. Meanwhile, in case the second recording medium is selected as a recording medium, carriage and recording can be performed while the second recording medium is securely maintained to be in contact with the discharging driven roller, because the discharging driven roller can be positioned within the recording medium transfer path by allowing the recording medium stacker to be in the second position.

According to the third aspect of the present invention, a recording apparatus comprises a recording medium feeding mechanism for feeding a recording medium including a hard recording medium and a non-hard recording medium in a recording medium transfer path one at a time; a recording head provided downstream of said recording medium feeding apparatus for performing recording on the recording medium at a record performing area; a discharging roller provided in the medium transfer path at a downstream of said recording head, comprising a discharging driven roller provided to a recording side of the recording medium and a discharge driving roller provided to a non-recording side of a recording medium, for discharging the medium on which recording is performed; and a recording medium stacker having a recording medium stacking surface operated to change between a first position where said discharging driven roller is separated from the recording medium transfer path, said first position constituting a straight a medium feeding and/or discharging path extending between said recording medium stacking surface and said record performing area, said first position is selected when recording is performed on the hard recording medium, and the hard recording medium being transferred back and forth in said medium feeding and/or discharging path, and a second position where said discharging driven roller is in contact with said discharge driving roller and the recording medium is discharged and stacked, said second position is selected when recording is performed on the non-hard recording medium fed by said recording medium feeding mechanism.

According to the present invention, the position of the discharging driven roller can be changed to the corresponding state, following the position of the recording medium stacker.

That is, in case the recording medium stacker is in the second position which is selected when recording is performed on recording medium which can be fed by the recording medium feeding mechanism (e.g. normal papers, postcards and envelops), the discharging driven roller is designed to be in contact with the discharge driving roller, so that the materials on which recording has been performed after being fed by the recording medium feeding mechanism can be firmly discharged, and the materials which have been discharged can be precisely stacked in the recording medium stacker.

And, in case the recording medium stacker is in the first position which is selected when recording is performed on hard recording medium (things for which it is difficult or impossible to feed by the recording medium feeding mechanism, e.g. CD-R, thick board papers), the discharging driven roller is designed to be separated from the discharge driving roller, so that the hard recording medium can be prevented from contacting with the discharging driven roller. Therefore, for example, in case the hard recording medium is CD-R, recording can be performed while the discharging driven roller is not in contact with the CD-R, a undesired condition which occurs when a discharging driven roller with a toothed roller is in contact with the CD-R (e.g. contact traces on the recording side, influences on the data memory layers) can be securely avoided.

According to the fourth aspect of the present invention, a recording apparatus comprises a recording medium feeding mechanism provided at an upstream of a recording medium transfer path for feeding a recording medium, which is stacked and held on a slant, to a downstream by one at a time; a recording head provided at a downstream of said recording medium feeding apparatus for performing recording on the recording medium; a paper discharging roller provided at a downstream of said recording head, comprising a paper discharging driven roller provided on a recording side of the recording medium and a paper discharge driving roller provided on non-recording side of the recording medium, for discharging the recording medium on which recording is performed; a paper discharging frame for holding said paper discharging driven roller, said frame being operated to change between a contact state where said paper discharging driven roller is in contact with said paper discharge driving roller and a separation state where said paper discharging driven roller is separated from said paper discharge driving roller; a side frame provided at both sides of said paper discharging frame; a recording medium stacker operated to change between a first position where a hard recording medium is fed from a recording medium stacking surface, which is substantially horizontal, straight to said recording head and discharged in the same direction, a feeding and/or discharging path being straight, and a second position in which recording is performed on a recording medium, which is fed by said recording medium feeding apparatus, said medium which has been discharged being stacked; a link mechanism for changing a position of said paper discharging frame between said contact and separation states by changing a position of said recording medium stacker, said link mechanism allowing said paper discharging frame to be in said contact state by setting said recording medium stacker to be in said second position, and allowing said paper discharging frame to be in said separation state by setting said recording medium stacker to be in said first position.

According to the recording apparatus of the present invention, the position of the paper discharging frame can be changed to the corresponding state, following the position of the recording medium stacker. That is, the recording apparatus has a link mechanism for changing the position of the paper discharging frame between the contact state and the separation state by changing the position of the recording medium stacker, and the link mechanism allows the paper discharging frame to be in the contact state in case the recording medium stacker is in the second position and allows the paper discharging frame to be in the separation state in case the recording medium stacker is in the first position.

Therefore, since the paper discharging frame can be in the contact state by making the recording medium stacker be in the second position, the materials on which recording has been performed after being fed from the recording medium feeding mechanism can be firmly discharged, and the materials which have been discharged can precisely stacked in the recording medium stacker.

And, since the paper discharging frame can be in the separation state by making the recording medium stacker be in the first position, though the hard recording medium having thickness such as a tray on which CD-R is set is carried, the discharging driven roller accompanying the paper discharging frame is separated from the recording medium transfer path, so recording can be performed while the paper discharging driven roller is prevented from being in contact with the hard recording medium. Accordingly, a undesired condition caused by the contact of the paper discharging driven roller with the hard recording medium (e.g. contact traces on the recording side, influences on the data memory layers) can be securely avoided.

Further, since the position of the paper discharging frame can be changed to the state corresponding to the recording medium stacker as only a user changes the position of the recording medium stacker, this operation is extremely simple and operational mistakes do not occur. Therefore, it is possible to securely prevent the concern about the contact of the paper discharging driven roller with the hard recording medium due to the operational mistakes, which occur when an operation lever is provided additionally to operate the paper discharging frame.

The position of the paper discharging frame may be changed between the contact and separation states, while a posture of the paper discharging frame in the contact state is maintained. According to the recording apparatus of the present invention, the materials fed by the recording medium feeding mechanism can be firmly discharged toward the recording medium stacker, in case the paper discharging frame is in the contact state. In case the paper discharging frame is in the separation state, it is possible to securely prevent the contact of the paper discharging driven roller with the hard recording medium.

The paper discharging frame may be urged toward the contact state by an urging means. According to the recording apparatus of the present invention, the paper discharging frame can be in the contact state by the urging means as the recording medium stacker is in the second position. And, the position of the paper discharging frame in the contact state can be firmly determined.

The link mechanism may include a release lever sub engaged with the recording medium stacker to be capable of moving up and down against the apparatus, following a position change of the recording medium stacker, a release lever provided at a rotating shaft to be capable of rotate around the rotating shaft by sliding a sliding groove formed at the release lever sub, and a link frame engaged with the release lever via the rotating shaft to be incapable of rotating against the release lever, wherein paper discharging frame may be rotatably engaged with the link frame. According to the recording apparatus of the present invention, it is possible to make the link mechanism for changing the position of the paper discharging frame between the contact state and the separation state with simple configurations and by precisely following the position change of the recording medium stacker.

The cross-section of the rotating shaft may be a rectangle shape. According to the recording apparatus of the present invention, the rotation of the release lever can be firmly transferred to the link frame, so the link frame does not rotate against the release lever, that is, the release lever and the link frame can rotate in the same direction and by the same amount.

An engaging projection may be formed at the side frame, for determining a position of the paper discharging frame to be in contact state by engaging with the paper discharging frame. According to the recording apparatus of the present invention, in regard to the paper discharging frame being changed between the contact state and the separation state, determining the position in the contact state is simple and can be firmly performed.

A guide slant may be formed at the side frame for guiding a position change of the paper discharging frame between the contact and separation states, while maintaining a posture of the paper discharging frame in the contact state, in case the separation state is slanting upwards to the contact state. According to the recording apparatus of the present invention, in case the separation state is designed to slant upwards to the contact state, the position change of the paper discharging frame between the contact and separation states can be smoothly performed while maintaining the posture of the paper discharging frame in the contact state, because the position change of the paper discharging frame is guided by the guide slant.

A guide slant may be formed at the side frame for guiding a position change of the paper discharging frame in order that an upstream of the paper discharging frame is separated more upwards than a downstream of the paper discharging frame, in case the separation state is slanting upwards to the contact state. According to the structure, the upstream of the paper discharging frame can be moved more than the downstream, so the paper discharging frame at which the paper discharging driven roller is installed can be securely separated from the recording medium transfer path.

According to the fifth aspect of the present invention, a recording apparatus comprises a recording medium feeding mechanism for feeding a recording medium to a downstream by one at a time; a recording head provided at a downstream of said recording medium feeding apparatus for performing recording on a recording medium; a paper discharging frame provided at a downstream of said recording medium feeding apparatus, said paper discharging frame being operated to change between an approach state positioned right above a recording medium transfer path and a separation state positioned more upwards than said approach state; a paper discharging driven roller installed in said paper discharging frame, projecting downwards; a paper discharge driving roller provided to a bottom of said paper discharging frame independently for discharging a material on which recording is performed by rotating; a side frame provided at both sides of said paper discharging frame; a recording medium stacker capable of being changed to a first position in which a hard recording medium is fed from a recording medium stacking surface, which is substantially horizontal, straight to said recording head and discharged in the same direction, a feeding and/or discharging path being straight, and a second position, lower than said first position, in which recording is performed on a recording medium, which can be fed by said recording medium feeding apparatus, said material which has been discharged being stacked; and a link mechanism for changing a position of said paper discharging frame between said approach and separation states by changing a position of said recording medium stacker, said link mechanism allowing said paper discharging driven roller to approach said recording medium transfer path via said paper discharging frame by setting said recording medium stacker to be in said second position, and allowing said paper discharging driven roller to be separated from said recording medium transfer path via said paper discharging frame by setting said recording medium stacker to be in said first position.

The recording apparatus may comprise a platen gap position change link mechanism for adjusting a distance between the recording head and a platen, following a position of the recording medium stacker, wherein the platen is provided opposite to the recording head for supporting a recording medium to a non-recording side of the material.

The recording apparatus may comprise a transfer driven roller position change link mechanism for allowing a transfer driven roller to be in contact with a transfer driving roller in case the recording medium stacker is in the second position, and allowing the transfer driven roller to be separated from the transfer driving roller in case the recording medium stacker is in the first position, wherein the transfer driven roller is provided to a recording side of a recording medium, and the transfer driving roller is provided to a non-recording side of a recording medium, near an upstream of the recording head.

According to the sixth aspect of the present invention, a liquid ejection apparatus comprise a material feeding apparatus for feeding a medium to be liquid-ejected by one at a time; a liquid ejection head provided at a downstream of said material feeding apparatus for applying a liquid to a medium to be liquid-ejected; a discharging roller provided at a downstream of said liquid ejection head, comprising a discharging driven roller provided to a liquid applying side of a medium to be liquid-ejected and a discharge driving roller provided to a liquid non-applying side of a medium to be liquid-ejected, for discharging a material to which a liquid has been applied; and a material stacker operated to change between a first position where said discharging driven roller is in contact with said discharge driving roller, said first position being selected in case jetting is performed on a hard medium to be liquid-ejected, said hard medium to be liquid-ejected being transferred back and forth between a material stacking surface and a ejection performing region while a feeding and/or discharging path is straight, and a second position where said discharging driven roller is separated from a material medium transfer path, said second position being selected in case jetting is performed on a medium to be liquid-ejected, which can be fed by said recording medium feeding apparatus, said material which has been discharged being stacked.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Hereinafter, an inkjet printer is taken as an example of the recording apparatus and the liquid ejection apparatus relating to the present invention. Here, it will be described according to the following order:

1. The overall configuration of the inkjet printer
2. The configuration of the paper discharging frame position change link mechanism
3. The configurations of the transfer driven roller position change link mechanism and the platen gap position change link mechanism 1. The Overall Configuration of the Inkjet Printer First, the overall configuration of the inkjet printer 1 relating to the present embodiments (hereinafter referred to as "printer") will be described referring to FIG. 1 and FIG. 2.

Figure 1:
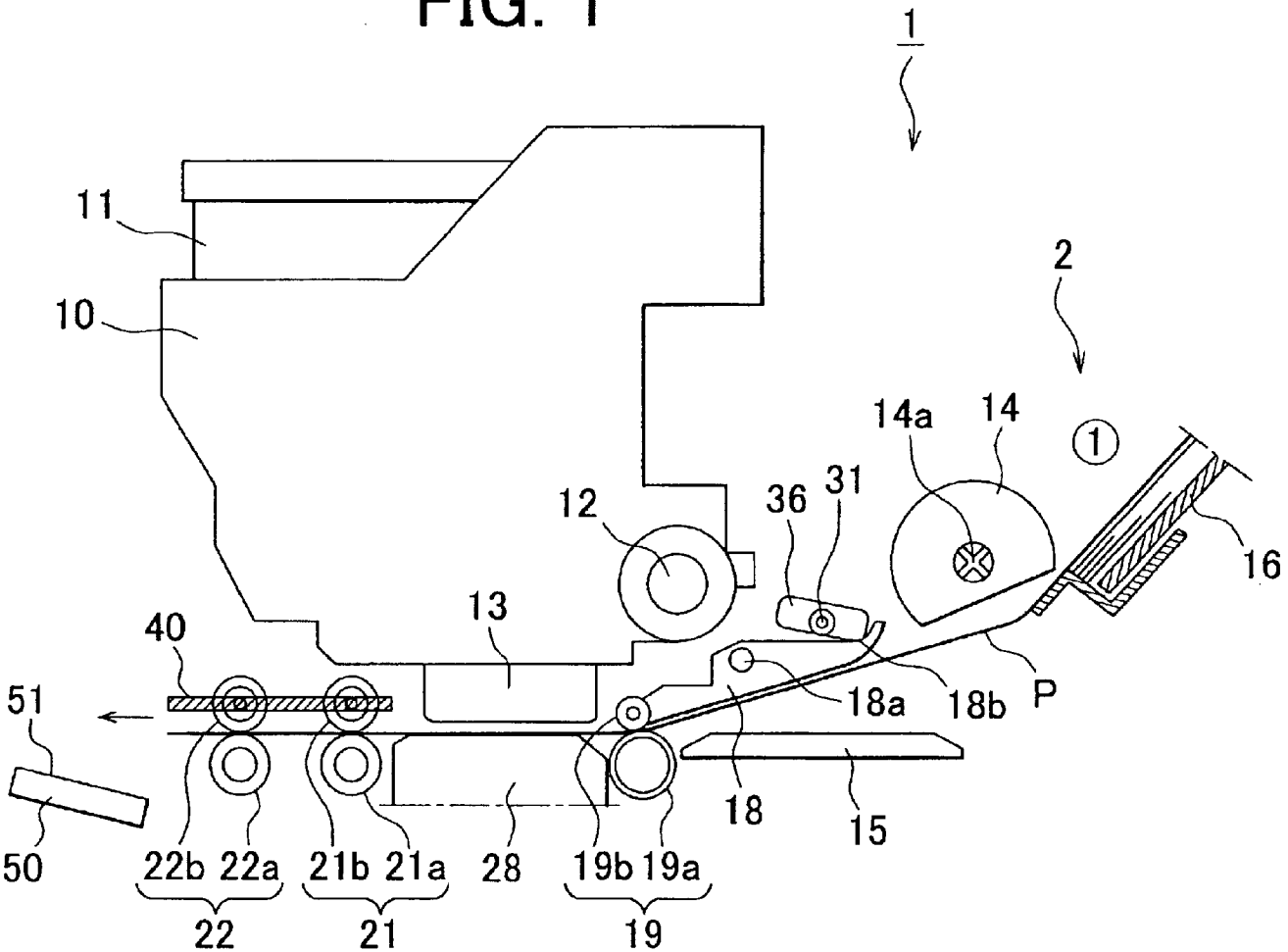
FIG. 1 is a partly omitted side view of the printer 1, showing the state in which printing (recording) is performed on papers P using the first medium transfer path (1).
Figure 2:
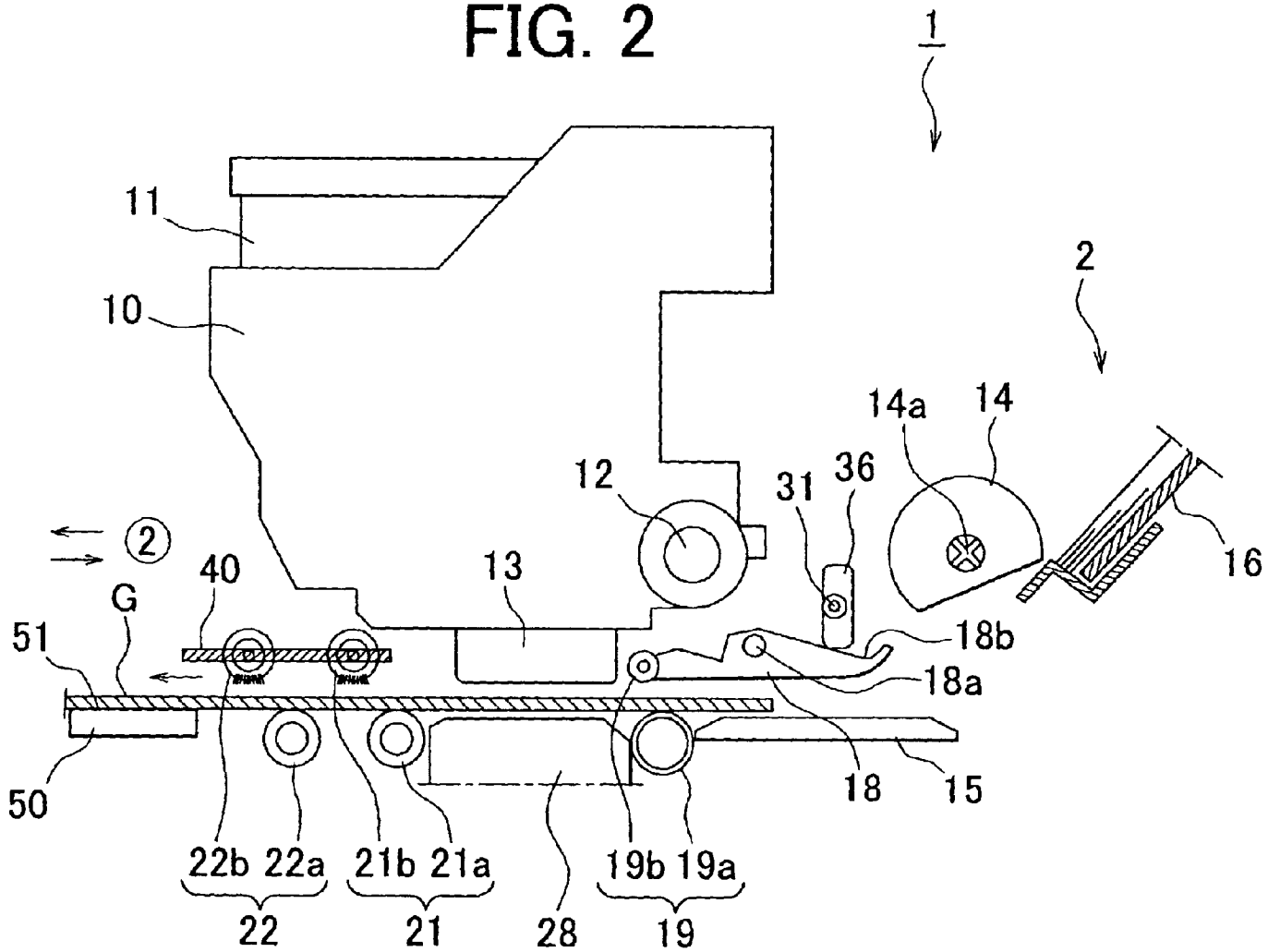
FIG. 2 is a side view of the printer 1 partly omitted, showing the state in which printing (recording) is performed on hard recording medium G using the second medium transfer path (2).

Here, FIG. 1 is a side view of the printer 1 partly omitted, showing the state in which printing (recording) is performed on papers P using the first medium transfer path (1) to be described later, and FIG. 2 is a side view of the printer 1 partly omitted, showing the state in which printing (recording) is performed on hard recording medium G using the second medium transfer path (2) to be described later.

Here, as the second recording medium later in the state where a discharging roller to be described later is in contact with a paper discharging driven roller, "papers P" represents the recording medium available to feed being vent using a paper feeding mechanism 2 as a recording medium feeding mechanism to be described later (e.g. recording medium having the flexibility such as normal papers, postcards and envelopes), as the first recording medium later in the state where the discharging roller to be described later is not in contact with the paper discharging driven roller, "hard recording medium G" represents the recording medium difficult or impossible to feed being vent (e.g. recording medium having the hardness such as CD-R and thick board paper) and "recording medium" represents these all together.

The printer 1 has, as shown in FIG. 1, the first medium transfer path (1), wherein the papers P are fed in one direction as the paper feeding mechanism 2 is provided to supply the papers P at the upstream of the recording medium transfer path, the back of the apparatus (the right side in FIG. 1), the papers P are stacked and held on a slant by the paper feeding mechanism 2, printing is performed while one piece at a time is fed being vent to the downstream and then the papers P are discharged from the front of the apparatus (the left side in FIG. 1) horizontally, and, as shown in FIG. 2, the second medium transfer path (2) of straight line, wherein the hard recording medium G are transferred back and forth as printing is performed by feeding the hard recording medium G from the recording medium stacker 50 provided at the front of the apparatus toward a recording head 13 almost horizontally and then the hard recording medium G are discharged to the front of the apparatus again.

Moreover, the recording medium stacker 50, as described in detail later, has the position changeable configuration to be capable of taking the second position which is set in case of using the first medium transfer path (1) and the first position which is set in case of using the second medium transfer path.

First, the first medium transfer path (1) will be described according to the operation referring to FIG. 1. In this case, the recording medium stacker 50 takes the second position.

The paper feeding mechanism 2 has a hopper 16 and a paper feeding roller 14 in the shape of D viewed from the side. The hopper 16 can stack and hold a plurality of papers P in slant position, and has the configuration to perform pressing and separating onto and from the paper feeding roller 14 by swinging from a center (not shown) provided at the upstream. The paper feeding roller 14 can rotate around a rotating shaft 14*a*, and its surface is made of a high friction material so that it can firmly feed the papers in contact with it.

The papers P set in the hopper 16 is pushed up by the pressing operation of the hopper 16 onto the paper feeding roller 14, and the top of the papers P comes in contact with the paper feeding roller 14. At this contact state, the top piece of the papers P is fed to the downstream being separated from the next piece of the papers P by the rotation of the paper feeding roller 14 (a clockwise direction in FIG. 1).

A paper guide 15 is provided under the lower flow of the paper feeding roller 14 almost horizontally, and guides the papers P fed from the paper feeding mechanism 2 to the downstream.

A transfer roller 19 is provided at the downstream of the paper guide 15, and it consists of a transfer driving roller 19*a* provided at the non-recording side of the papers P (i.e. the back of the papers P) to be rotated by a driving means not shown and a transfer driven roller 19*b* provided at the recording side of the papers P (i.e. the front of the papers P) to be rotated subordinately in contact with the transfer driving roller 19*a*. The transfer driving roller 19*a* is the shape of a rod which is long in the main scanning direction (the front and back direction to the paper surface in FIG. 1) perpendicular to the medium transfer path of the papers P, and the transfer driven roller 19*b* is short in the main scanning direction and a plurality of the transfer driven roller 19*b* is provided in the main scanning direction at a predetermined interval. The papers P are held by the transfer roller 19 having this configuration and they are carried with high accuracy.

The transfer driven roller 19*b* is rotatably supported by a shaft at the downstream of a transfer driven roller holder 18 to freely rotate. The transfer driven roller holder 18 can swing around a swing shaft 18*a* and besides always is urged toward the transfer driving roller 19*a* by a coil spring as an urging means (not shown). Owing to the structure the papers P can be firmly held to be given the transfer force so that they can be securely send with accuracy.

A cam member 36 is provided above the upstream of the transfer driven roller holder 18 to be capable of rotating around a cam rotating shaft 31 as a means to make the transfer driven roller holder 18 swing. The cam rotating shaft 31 is controlled by a transfer driven roller position change link mechanism 200 to be described later, and the transfer driven roller holder 18 is swung by rotating the cam rotating shaft 31 to make the cam member 36 be in contact with a cam follower part 18*b*.

Owing to the structure, the transfer driven roller holder 18 can allow the transfer driven roller 19*b* to be in contact with the transfer driving roller 19*a* (cf. FIG. 1) and allow the transfer driven roller 19*b* to be separated from the transfer driving roller 19*a* (cf. FIG. 2).

A recording unit for performing printing is provided near the downstream of the transfer roller 19. A platen 28 and a print head 13 are provided in the recording unit to face each other up and down. The platen 28 is designed to be long in the main scanning direction and be capable of supporting the papers P, which are transferred and come in, to the back of them (the non-recording side).

The recording head 13 is mounted at the bottom of a carriage 10. The carriage 10 is supported by a carriage guiding shaft 12 extending in the main scanning direction (the direction of the width of the papers P), and moves back and forth along the carriage guiding shaft 12. Moreover, the carriage 10 has a plurality of ink cartridges 11 of such colors as yellow, magenta, cyan and black freely attachable and detachable, and it is designed to be capable of performing color printing by ejecting drops of the colorful ink from the recording head 13 while moving back and forth along the carriage guiding shaft 12.

The carriage guiding shaft 12 is designed to be capable of changing its position in the direction perpendicular to the platen 28 (the up and down direction in FIG. 1) gearing with the recording medium stacker 50 by a platen gap position change link mechanism 300, and to be capable of adjusting the distance between the recording head 13 and the platen 28 (what is called the platen gap. Hereinafter, "PG" represents it) by changing its position corresponding to the thickness of the recording medium in case of choosing and using the papers P or the hard recording medium G as the recording medium.

That is, since the printing quality is significantly affected by the paper gap, the distance between the recording surface of the recording medium, which are carried to the platen 28, and the recording head 13, the dimension of the platen gap is set considering the paper gap.

Accordingly, the PG is set to be relatively small in order that the carriage 10 is more closer to the platen 28 (hereinafter, "position N" represents it. Cf. FIG. 1) in case of performing printing on the papers P, and the PG is set to be relatively big in order that the carriage 10 is separated from the platen 28 other than the position N (hereinafter, "position ++" represents it. Cf. FIG. 1) in case of performing printing on the hard recording medium G. In addition hereinafter, "PG normal" represents the platen gap set in case the carriage 10 is in the position N, and "PG ++" represents the platen gap set in case the carriage 10 is in the position ++.

A discharging unit for the papers P is arranged at the downstream against the recording unit, where a paper discharging roller as a discharging roller is provided which consists of a pair of paper discharge driving rollers as a discharge driving roller being a discharging means and a pair of paper discharging driven rollers as a discharging driven roller. More specifically, a first paper discharging roller 21 is provided near the downstream of the position in which the recording head 13 and the platen 28 face each other to consists of a first paper discharge driving roller 21*a* and a first paper discharging driven roller 21*b* and a second paper discharging roller 22 is provided at the downstream more than the first paper discharging roller 21 to consists of a second paper discharge driving roller 22*a* and a second paper discharging driven roller 22*b*. Further, "paper discharging rollers (21, 22)" represents the first paper discharging roller 21 and the second paper discharging roller 22 all together, "paper discharge driving rollers (21*a*, 22*a*)" represents the first paper discharge driving roller 21*a* and the second paper discharge driving roller 22*a* all together and "paper discharging driven rollers (21*b*, 22*b*)" presents the first paper discharging driven roller 21*b* and the second paper discharging driven roller 22*b*.

The paper discharge driving rollers (21*a*, 22*a*) are provided at the non-recording side of the papers P (i.e. the back of the papers P) to be rollers in the shape of a rod extending in the main scanning direction near which a cam member is provided, and their rotation is controlled by a driving means which is not shown.

Meanwhile, the paper discharging driven rollers (21*b*, 22*b*) are provided at the recording side of the papers P (i.e. the front of the papers P), and are designed to be toothed rollers having a plurality of teeth on their circumference. And, they are installed in the paper discharging frame to be capable of rotating freely, projecting downward (i.e. toward the recording medium transfer path).

The paper discharging frame 40 is designed to be capable of changing its position to take the contact state in which the paper discharging driven rollers (21*b*, 22*b*) are in contact with the paper discharge driving rollers (21*a*, 22*a*) as positioned in the recording medium transfer path (cf. FIG. 1) and the separation state in which the paper discharging driven rollers (21*b*, 22*b*) are separated from the paper discharge driving rollers (21*a*, 22*a*) as positioned out of the recording medium transfer path(cf. FIG. 2), gearing with the position change of the recording medium stacker 50 by a paper discharging frame position change link mechanism 100 as a "link mechanism" to be described later. That is, the paper discharging frame 40 is designed to be capable of taking the approach state in which the paper discharging driven rollers (21*b*, 22*b*) are positioned right above the recording medium transfer path to be in the recording medium transfer path (corresponding to the contact state) and the separation state in which the paper discharging driven rollers (21*b*, 22*b*) are separated from the recording medium transfer path as positioned upward against the approach state (corresponding to the separation state above). The papers P are discharged toward the recording medium stacker 50 by the paper discharging rollers (21, 22) having the structure disclosed above.

Next, it will be described that printing is performed on the hard recording medium G using the second medium transfer path (2) referring to FIG. 2. In this case, a paper feeding and discharging path for the hard recording medium G is made to be straight to the bottom of the recording head 13, wherein a recording medium stacking surface 51, the top of the recording medium stacker 50, is approximately horizontal by setting the recording medium stacker 50 in the first position. Moreover, the paper discharging frame 40 is moved to the position at which the paper discharging driven rollers (21*b*, 22*b*) are at least not in contact with the hard recording medium G in the separation state, as geared with the recording medium stacker 50 by the paper discharging frame position change link mechanism 200 to be described later. Owing to this, printing can be performed as the paper discharging driven rollers (21*b*, 22*b*) are not in contact with the hard recording medium G.

Further, the transfer driven roller 19*b* is separated from the transfer driving roller 19*a* by the paper discharging frame position change link mechanism 200 to be described later. Owing to this, the hard recording medium G can be prevented from colliding with the transfer driven roller 19*b*, and be held and send by the transfer roller 19 with precision.

In addition, the hard recording medium G can be prevented from being contact with the recording head 13 as the carriage 10 is set in the position ++, geared with the recording medium stacker 50 by the platen gap position change link mechanism 300 to be described later, and the platen gap can be adjusted corresponding to the hard recording medium G.

In this way, the state in which the hard recording medium G can be carried straight is prepared, then the hard recording medium G are set in the recording medium stacker 50, inserted toward the bottom of the recording head 13 (i.e. the recording unit) along the recording medium stacking surface 51 and then printing is performed. In this way, printing can be performed as the hard recording medium G are prevented from being in contact with the paper discharging driven rollers (21*b*, 22*b*).

Further, in case the hard recording medium G are such optical recording media as CD-R incapable of being carried directly, printing is performed as a tray for exclusive use (e.g. a tray in which a groove is formed for putting CD-R) is set.

2. The Configuration of the Paper Discharging Frame Position Change Link Mechanism Next, the paper discharging frame position change link mechanism 100 will now be described referring to FIG. 3 to FIG. 8, wherein it changes the position of the paper discharging frame 40 to be in either the contact state or the separation state by changing the position of the recording medium stacker 50.

Figure 3:
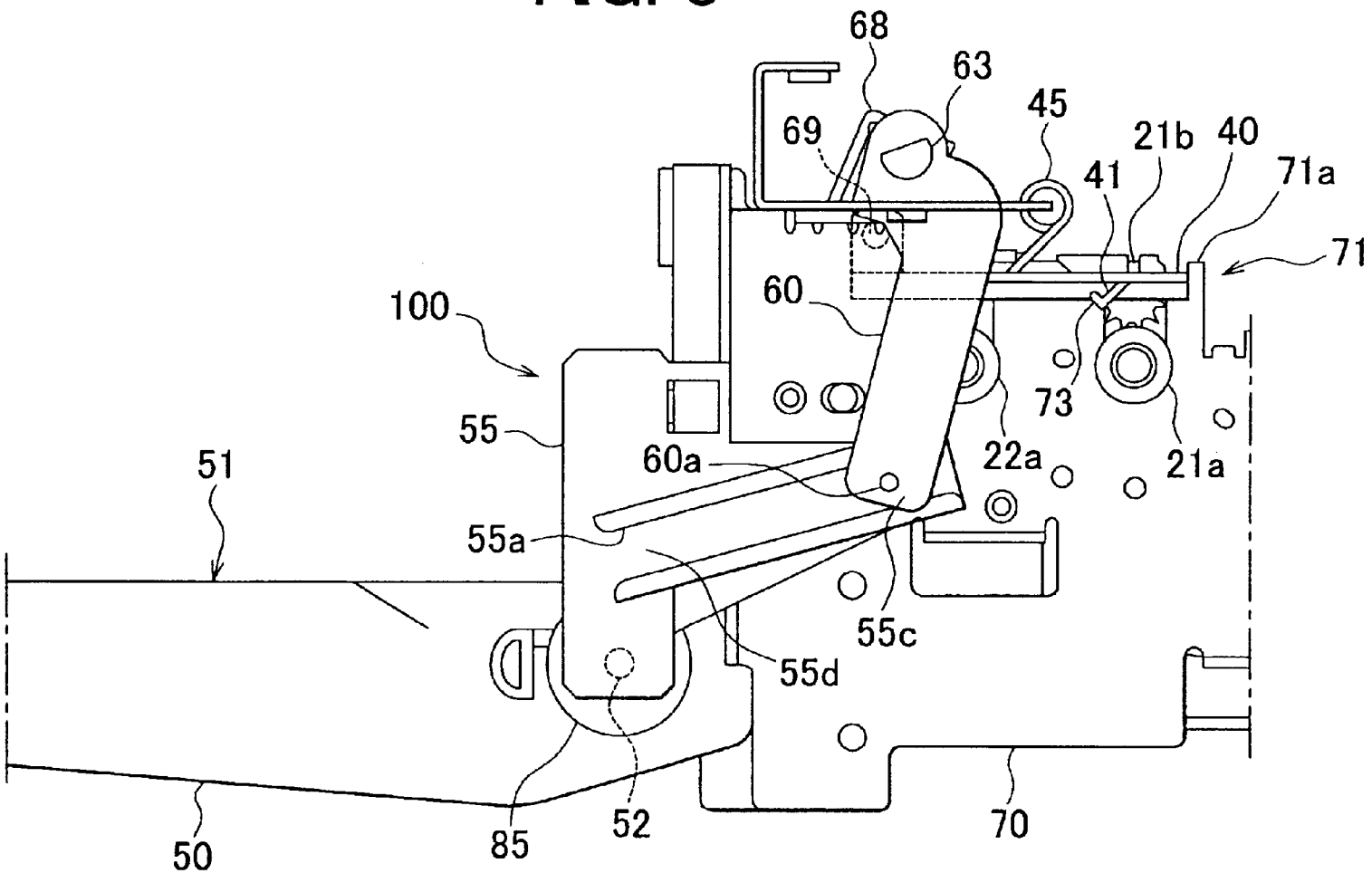
FIG. 3 is a principal part side view of the paper discharging frame position change link mechanism 100 relating to the present embodiment.
Figure 4:
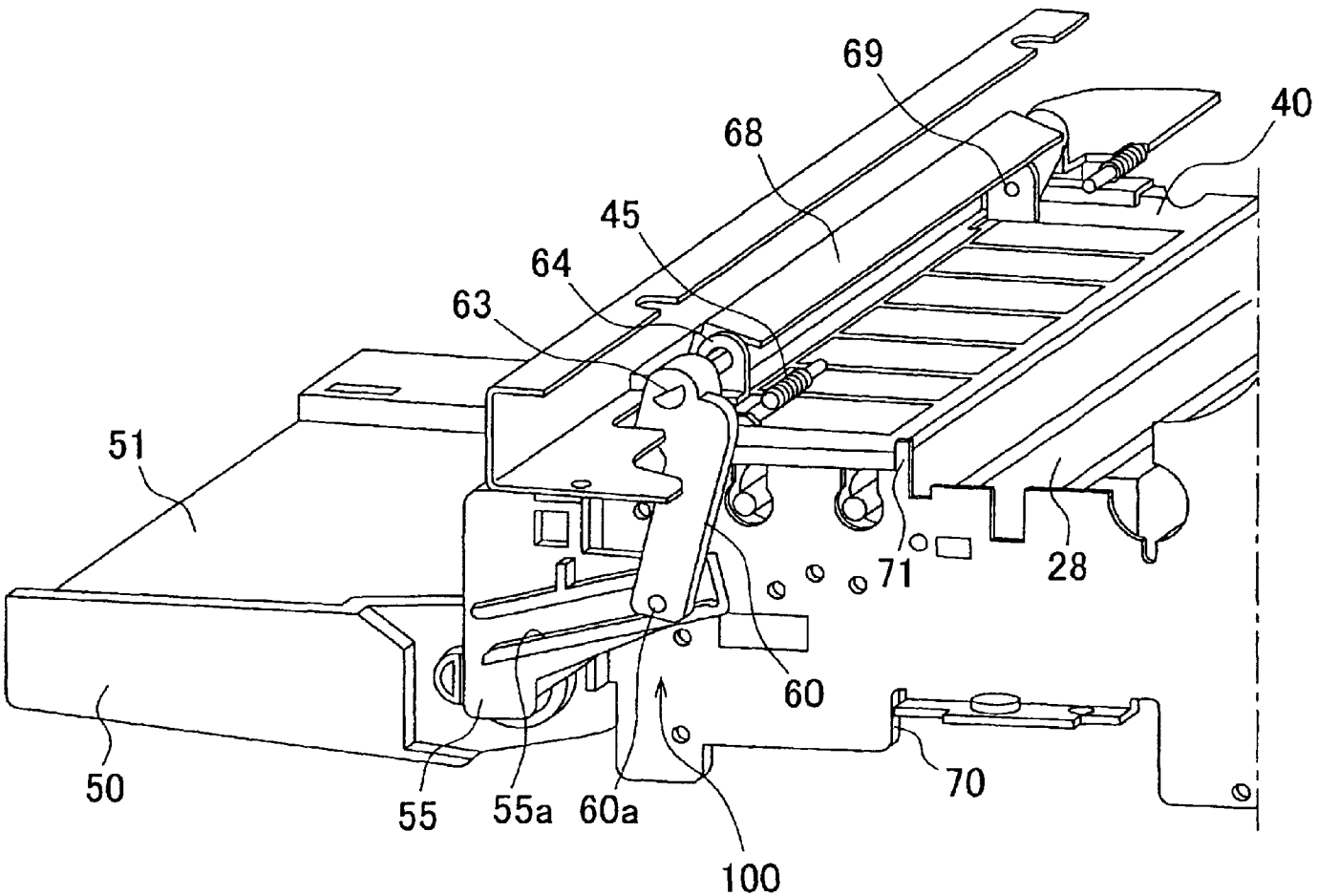
FIG. 4 is a principal part perspective view of the same part shown in FIG. 3, depicting the state where the recording medium stacker 50 is in the second position.
Figure 5:
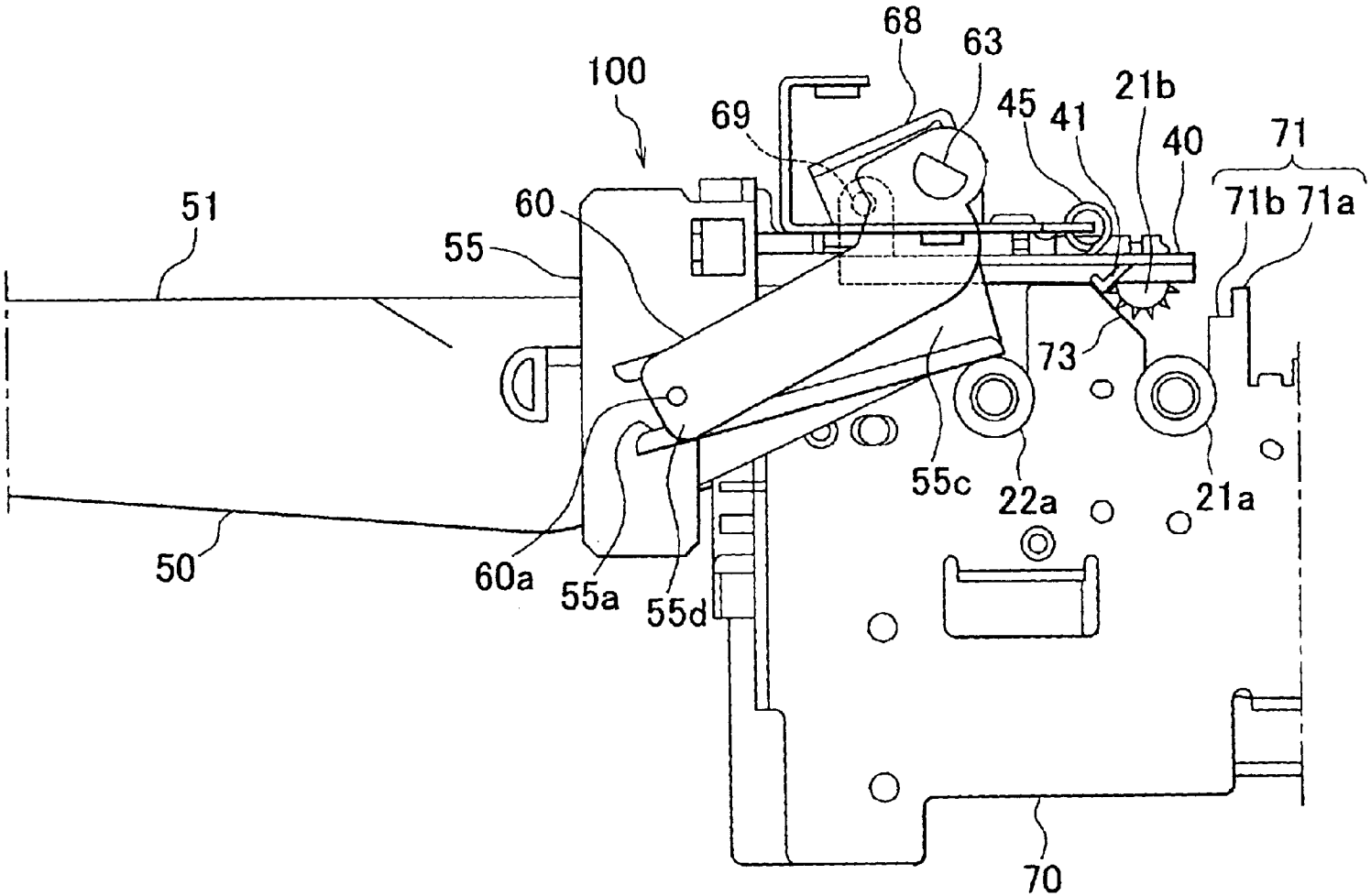
FIG. 5 is a principal part side view of the paper discharging frame position change link mechanism 100 relating to the present embodiment.
Figure 6:
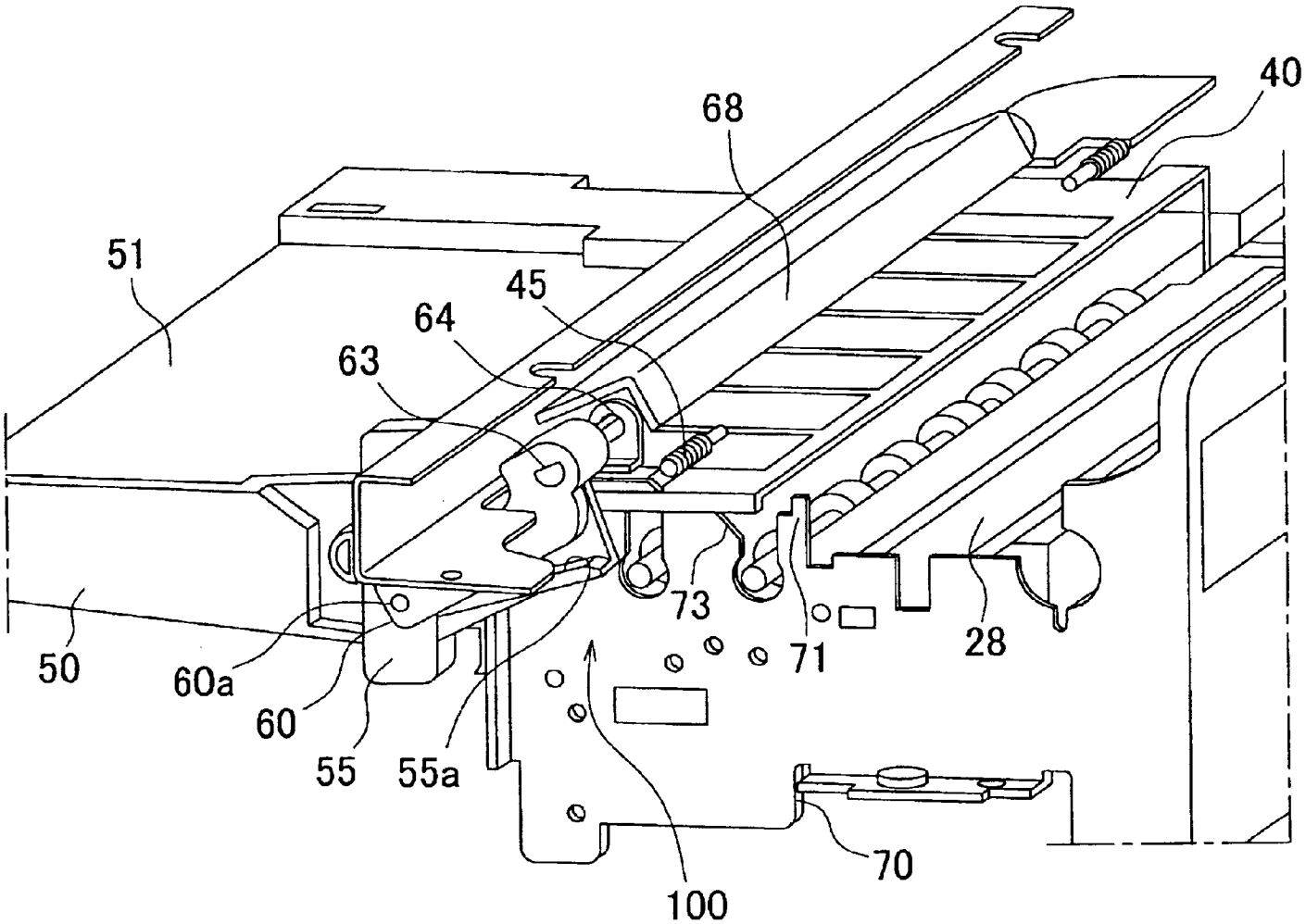
FIG. 6 is a principal part perspective view of the same part shown in FIG. 5, depicting the state where the recording medium stacker 50 is in the first position.
Figure 7:
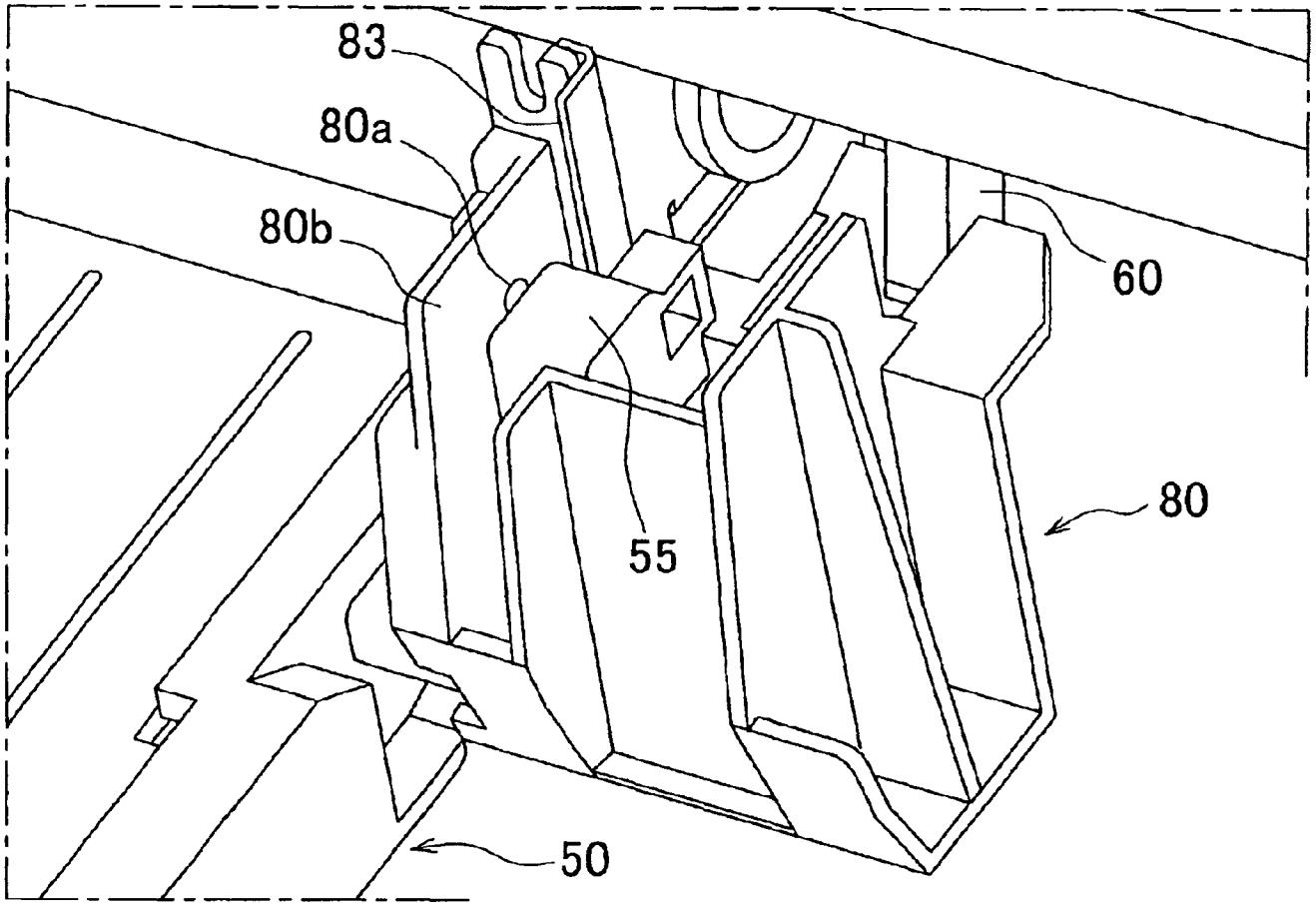
FIG. 7 is a principal part perspective view of a guide cover 80 provided near the right end of the recording medium stacker 50 viewed from the upper position of the downstream.
Figure 8:
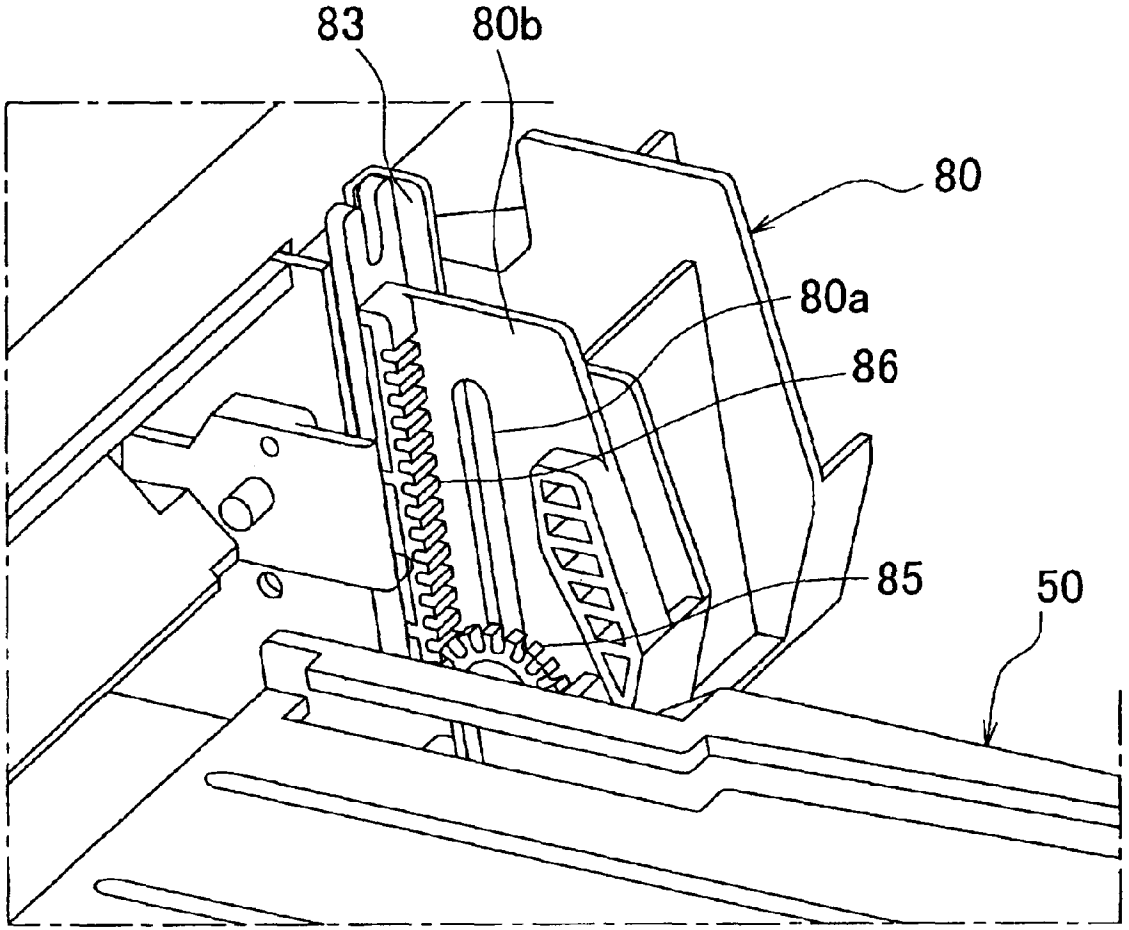
FIG. 8 is a principal part perspective view of the guide cover 80 shown in FIG. 7, viewed at a different angle.

Here, FIG. 3 is a principal part side view of the paper discharging frame position change link mechanism 100 relating to the present embodiment, and FIG. 4 is a principal part perspective view of the same part shown in FIG. 3, depicting the state where the recording medium stacker 50 is in the second position. And, FIG. 5 is a principal part side view of the paper discharging frame position change link mechanism 100 relating to the present embodiment, and FIG. 6 is a principal part perspective view of the same part shown in FIG. 5, depicting the state where the recording medium stacker 50 is in the first position. Further, FIG. 7 is a principal part perspective view of a guide cover 80 provided near the right end of the recording medium stacker 50 viewed from the upper position of the downstream, and FIG. 8 is a principal part perspective view of the guide cover 80 shown in FIG. 7, viewed at a different angle. And, FIG. 3 to FIG. 8 shows the right side of the recording medium stacker 50 in case of viewing the printer 1 at the front of it, and FIG. 3 to FIG. 6 shows the printer 1 viewed at the right side of it.

The recording medium stacker 50 provided at the front of the printer 1 is designed to be capable of changing its position to take the first position forming a straight feeding and discharging path in which the hard recording medium G are fed from the top of the recording medium stacking surface 51 straight to the bottom of the recording head 13 and discharged from the bottom of the recording head 13 straight to the top of the recording medium stacking surface 51 (cf. FIG. 5 and FIG. 6) and to take the second position in which the papers P are stacked after they are fed by the paper feeding mechanism 2 to perform printing and discharged, and the recording medium stacking surface 51 is approximately on a slant as positioned lower than the first position (cf. FIG. 3 and FIG. 4).

The paper discharging frame position change link mechanism 100 has a release lever sub 55, a release lever 60, a rotating shaft 63 and a link frame 68. At both sides of the upstream of the recording medium stacker 50 (i.e. the base end of it) a pair of engaging shafts 52 are provided projecting from the sides, and one of these engaging shafts 52 is rotatably supported by a bearing unit (not shown) formed at the inner wall of the release lever sub 55. In this way, the recording medium stacker 50 is designed to be capable of swinging approximately 90 degrees around the engaging shafts 52 and taking an in-use state in which it is approximately horizontal when the printer 1 is in use and a receiving state (not shown) in which it is approximately vertical when the printer 1 is out of use. The recording medium stacker 50 is in the keeping state so that the stacking space can be lessened when the printer 1 is out of use. And, the other one of these engaging shafts 52 is rotatably supported by an operation member 90 to be described later (cf. FIG. 9).

The release lever sub 55 rotatably supporting the engaging shaft 52 is designed to be capable of moving up and down against the apparatus as following the change in the position of the first and second position of the recording medium stacker 50. More particularly, as shown in FIG. 7, the release lever sub 55 is guided by an inner wall of a guide cover 80 provided at the outer edge of the release lever sub 55, and also guided as a metal plate 83 in the shape of a plate projecting from the front of the apparatus and extending up and down is inserted in a groove formed at the release lever sub 55 to correspond the position of the metal plate 83 and extending up and down (not shown). Owing to this structure, the position of the release lever sub 55 can be firmly determined, and the release lever sub 55 can confidently follow the movement of the recording medium stacker 50 in the vertical direction. Moreover, as shown in FIG. 8, a movement path 80*a*, which is long in the up-and-down direction to the apparatus, for the engaging shaft 52 as a part of the guide cover 80 is formed at a wall part 80*b* provided between the recording medium stacker 50 and the release lever sub 55.

Returning to FIG. 3 to FIG. 6, a wall forming a sliding groove 55*a* is formed at release lever sub 55 as a whole. A boss part 60*a* of the release lever 60 is inserted in the sliding groove 55, and it slides the sliding groove 55*a* so that the release lever 60 is rotated around the rotating shaft 63 to follow the release lever sub 55. Moreover, as the release lever 60 is guided by the inner wall of the guide cover 80 described above, it is controlled not to be separated from the sliding groove 55*a* of the boss part 60*a*.

As the rotating shaft 63, which is D shape in cross-section, is inserted into a bearing opening, which is the same shape, formed at the release lever 60, it rotates with the same amount and in the same direction as those of the release lever 60. Another end of the rotating shaft 63 is inserted into the link frame 68, and it is designed to be capable of transferring the rotation of the release lever 60 to the link frame 68. Owing to the structure, it is possible to rotate the link frame 68 with the same amount and in the same direction as those of the release lever 60 by transferring the rotation of the release lever 60 to the link frame 68 thought the rotating shaft 63. That is, the link frame 68 is designed not to rotate against the release lever 60, so it is possible to rotate the link frame 68 and the release lever 60 to be synchronized.

Moreover, in both ends of the rotating shaft, namely near the engaging part of the release lever 60 and near the engaging part of the link frame 68, a circular ling 64 is provided to have a round opening which the rotating shaft 63 penetrates so that it supports the rotating shaft 63 to be capable of rotating and determines the position. Further, the shape of the rotating shaft 63 is not limited to the D shape like the present example, and the square shape such as triangle and rectangle can be used if only the rotation of the release lever 60 is transferred to the link frame 68 as it is.

The link frame 68 is rotatably engaged with the paper discharging frame 40 through an engaging shaft 69 at the downstream of the paper discharging frame 40. In this way, as the link frame 68 rotates around the rotating shaft 63, the position of the paper discharging frame 40 is changed to the contact state or the separation state.

Further, the paper discharging frame 40 is positioned toward the slant upstream, namely, is urged to be in the contact state by an urging spring 45 provided in that direction. Owing to this, the upstream end of the paper discharging frame 40 (the free end) is firmly engaged with the an engaging projection 71 to be described later, and the position of the paper discharging frame 40 can be precisely determined to be in the contact state. That is, in case the paper discharging frame position change link mechanism 100 operates, the paper discharging frame 40 can be in the separation state.

Further, a guide slant 73 is formed at a side frame 70 to guide the position change between the contact state and the separation state. This guide slant 73 is formed to be approximately the same as the locus of the engaging shaft 69 as a engaging part in which the link frame 68 and the paper discharging frame 40 are engaged with each other when the position in the contact state and the separation state of the paper discharging frame 40 is change. Further, a projection 41 of which the side view is J shape is formed at the paper discharging frame 40 to slide down the guide slant 73.

Owing to the structure, as the J shape projection 41 slides along the guide slant 73 in case the position of the paper discharging frame 40 is changed, the position of the paper discharging frame 40 can be changed to the contact state or the separation state while its posture in the contact state is kept. Therefore, since the paper discharging driven rollers (21*b*, 22*b*) installed in the paper discharging frame 40 is securely separated from the recording medium transfer path, they can be moved to the height position at which they are not in contact with the hard recording medium G such as CD-R.

Further, although the present example has been described about the configuration by which the position of the paper discharging frame 40 is changed to the separation state while it is kept to be approximately horizontal as the posture in the contact state, the posture in the separation is not limited to this, and any posture will be fine if only the paper discharging driven rollers (21*b*, 22*b*) are not in contact with the hard recording medium G as separated from the recording medium transfer path. Therefore, for example, the upstream of the paper discharging frame may be separated to be more upward than the engaging shaft 69.

Further, an engaging projection 71 is formed at the side frame 70 for determining the position of the paper discharging frame 40 in the contact state (cf. FIG. 5). The engaging projection 71 has a projection part 71*a* with which the upper flow end part of the paper discharging frame 40 is in contact and a frame placing part 71*b* for determining the height position by supporting the paper discharging frame 40 at its bottom.

Owing to the structure, the upstream position of the paper discharging frame 40 is determined as the upper flow end part of the paper discharging frame 40 is engaged with the engaging projection 71. And, since the paper discharging frame 40 is urged toward the downward direction of the upstream by the urging spring 45, its posture in the contact state can be precisely maintained as its position is determined by firmly and securely engaging with the engaging projection 71. Moreover, since the downstream of the paper discharging frame 40 is engaged with the link frame 68 via the engaging shaft 69 as described above, the height position is determined to the contact state and the separation state.

Here, it will be described that the position of the paper discharging frame 40 is changed from the contact state to the separation state as the position of the recording medium stacker 50 is changed from the second position (cf. FIG. 3 and FIG. 4) to the first position (cf. FIG. 5 and FIG. 6).

The recording medium stacker 50, as shown in FIG. 3 and FIG. 4, is in the contact state in which the paper discharging frame 40 allows the paper discharging driven rollers (21*b*, 22*b*) to be in contact with the paper discharging rollers (21*a*, 22*a*), by taking the second position. Moreover, the recording medium stacker 50 is designed in order that its posture in the second position is maintained as the engaging shaft 52 is positioned at the lower end of the movement path 80*a* formed at the guide cover 80 as shown in FIG. 8, and a projection part (not shown) which projects in the downward direction against the apparatus body is in contact with a panel (not shown) provided at the upstream more than the engaging shaft 52 in regard to the inside of the recording medium stacker 50.

At this state, the recording medium stacker 50 becomes an approximately vertical posture by rotating toward the apparatus body around the engaging shafts 52 (a clockwise direction in FIG. 3) in advance, and then it is lifted upwards. Owing to the structure, the release lever sub 55 follows and moves upwards, and the boss part 60*a* of the release lever 60 slides the slide groove 55 of the release lever sub 55 from the position 55*c* to the position 55*d*. The release lever 60, accompanying this, rotates around the rotating shaft 63 (a clockwise direction in FIG. 3).

The rotation of the release lever 60 is transferred to the link frame 68 via the rotating shaft 63, and the link frame 68 is rotated in the same direction and by the same amount. Owing to this, the paper discharging frame 40 engaged with the link frame 68 is lifted in the upward direction of the downstream by a force of the urging spring 45. At this time, since the J shape projection 41 at the upstream of the paper discharging frame 40 is lifted along the guide slant in the upward direction of the lower flow in the same way, the position of the paper discharging frame 40 can be changed to the separation state while its posture in the contact state is maintained.

And, as the recording medium stacker 50 is rotated toward the downstream so that the recording medium stacking surface 51 is approximately horizontal, the recording medium stacker 50 is in the first position as shown in FIG. 5 and FIG. 6 and the paper discharging frame 40 is in the separation state in which the paper discharging driven rollers (21*b*, 22*b*) is separated from the paper discharge driving rollers (21*a*, 22*a*).

In this way, since the paper discharging frame 40 can be in the separation state in case the recording medium stacker 50 is in the first position, the paper discharging driven rollers (21*b*, 22*b*) installed at the paper discharging frame 40 can be moved to the height position at which it is not in contact with the hard recording medium G by being separated from the recording medium transfer path. Therefore, as printing can be performed while the paper discharging driven rollers (21*b*, 22*b*) is not in contact with the hard recording medium G, it is possible to firmly prevent the undesired condition caused by such contact.

Next, it will be described in the same way that the position of the paper discharging frame 40 is changed from the separation state to the contact state as the position of the recording medium stacker 50 is changed from the first position (cf. FIG. 5 and FIG. 6) to the second position (cf. FIG. 3 and FIG. 4).

First, the recording medium stacker 50 becomes an approximately vertical posture by rotating toward the apparatus body around the engaging shafts 52 (a clockwise direction in FIG. 5), and then it is moved down. Owing to this, the release lever sub 55 follows and moves downwards, and the boss part 60*a* of the release lever 60 slides the slide groove 55 of the release lever sub 55 from the position 55*d* to the position 55*c*. The release lever 60, accompanying this, rotates around the rotating shaft 63 (a counter-clockwise direction in FIG. 3).

The rotation of the release lever 60 is transferred to the link frame 68 via the rotating shaft 63, and the link frame 68 is rotated in the same direction and by the same amount. Owing to this, the paper discharging frame 40 engaged with the link frame 68 is moved down in the downward direction of the upstream. At this time, the J shape projection 41 at the upstream of the paper discharging frame 40 is moved down along the guide slant in the downward direction of the upper flow in the same way, and the position of the paper discharging frame 40 is determined to the contact state as the upper flow end part of it is engaged with the engaging projection 71. Moreover, since the paper discharging frame 40 is urged toward the contact state by the urging spring 45 as described above, it can be firmly engaged with the engaging projection 71, so its position can be precisely determined to the contact state.

And, as the recording medium stacker 50 is rotated toward the downstream, the recording medium stacker 50 is in the second position as shown in FIG. 3 and FIG. 4 and the paper discharging frame 40 is in the contact state in which the paper discharging driven rollers (21*b*, 22*b*) is in contact with the paper discharge driving rollers (21*a*, 22*a*).

In this way, since the paper discharging frame 40 can be in the contact state in case the recording medium stacker 50 is in the second position, the printed papers P fed from the paper feeding mechanism 2 can be firmly discharged, and the discharged papers P can be firmly stacked on the recording medium stacker 50.

Moreover, a pinion 85 is installed at the engaging shafts 52 provided at both sides of the recording medium stacker 50 to be capable of rotating as shown in FIG. 8, and further a rack 86 is formed at the position corresponding to the apparatus body. Owing to the structure, the position of the recording medium stacker 50 can be changed while maintained in a balanced state. That is, in a case where the position of the recording medium stacker 50 is changed between the first position and the second position, both ends of the recording medium stacker 50 can be simultaneously moved by the same amount because the pinion is moved gearing with the rack 86. Therefore, there is no undesired condition in which the recording medium stacker 50 is moved out of balance.

As described above, the printer 1 has the paper discharging frame position change link mechanism 100 for changing the position of the paper discharging frame 40 between the contact state and the separation state maintaining the paper discharging driven rollers (21*b*, 22*b*) by changing the position of the recording medium stacker 50. For this reason, printing can be performed on the papers P using the first medium transfer path (1) in which the paper discharging frame 40 is in the contact state by allowing the recording medium stacker 50 to be in the second position, and can be performed on the hard recording medium G using the second medium transfer path (2) in which the paper discharging frame 40 is in the separation state by allowing the recording medium stacker 50 to be in the first position. Owing to the structure, printing can be performed on various recording medium firmly.

Moreover, in case of printing on, for example, CD-R using the second medium transfer path, the paper discharging driven rollers (21*b*, 22*b*) cannot be in contact with the CD-R because the paper discharging frame 40 follows the position change of the recording medium stacker 50 and gets in the separation state.

Further, since the position of the paper discharging frame 40 can be changed to the state corresponding to the recording medium stacker 50 as only a user changes the position of the recording medium stacker 50, there is no concern that operational mistakes occur, and the configuration of the apparatus is simple.

3. The Configurations of the Transfer Driven Roller Position Change Link Mechanism and the Platen Gap Position Change Link Mechanism Next, the configurations of the transfer driven roller position change link mechanism and the platen gap position change link mechanism will be described.

Figure 9:
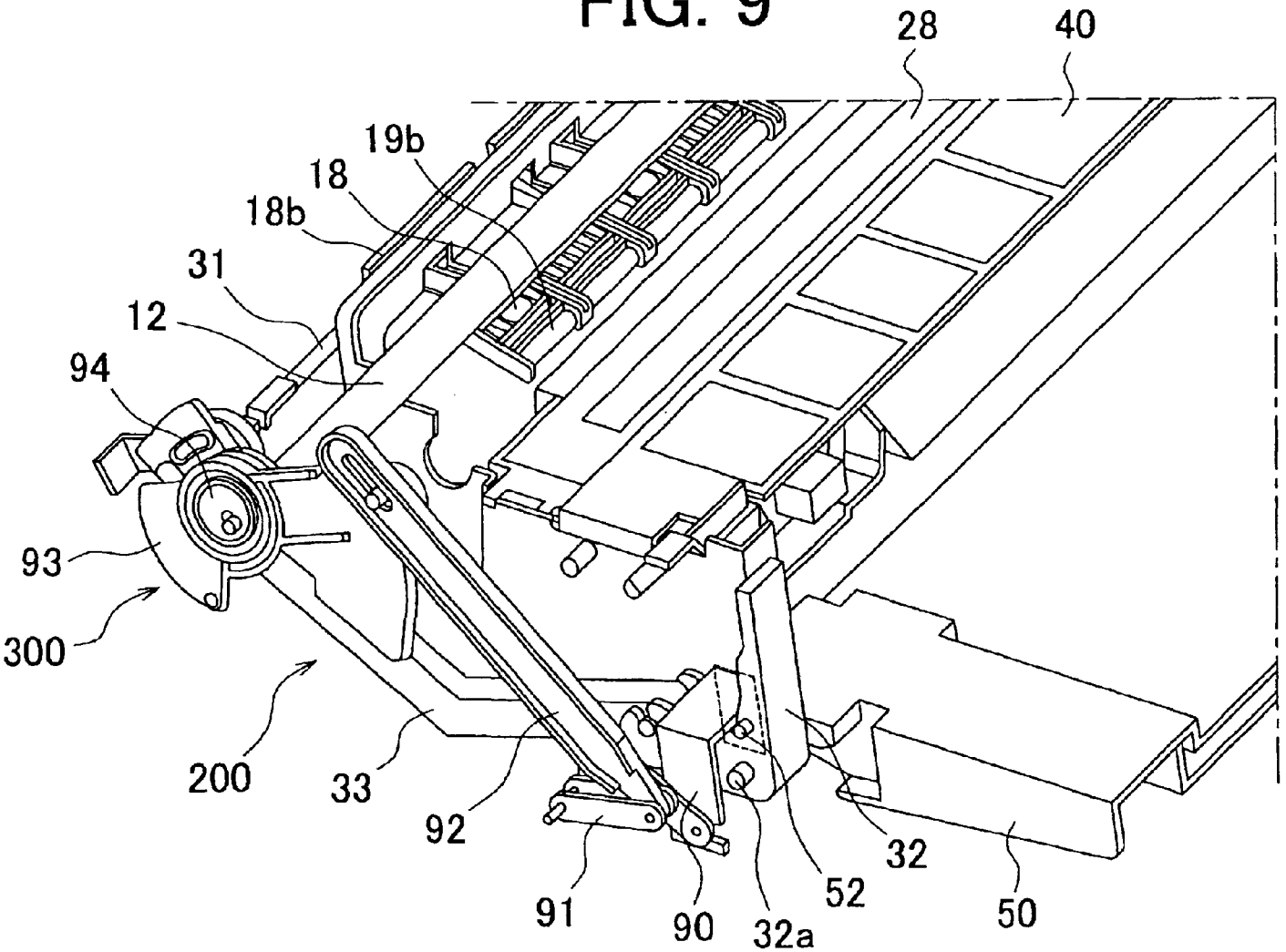
FIG. 9 is a principal part perspective view of the transfer driven roller position change link mechanism 200 and the platen gap position change link mechanism 300 relating to the present example.
Figure 10:
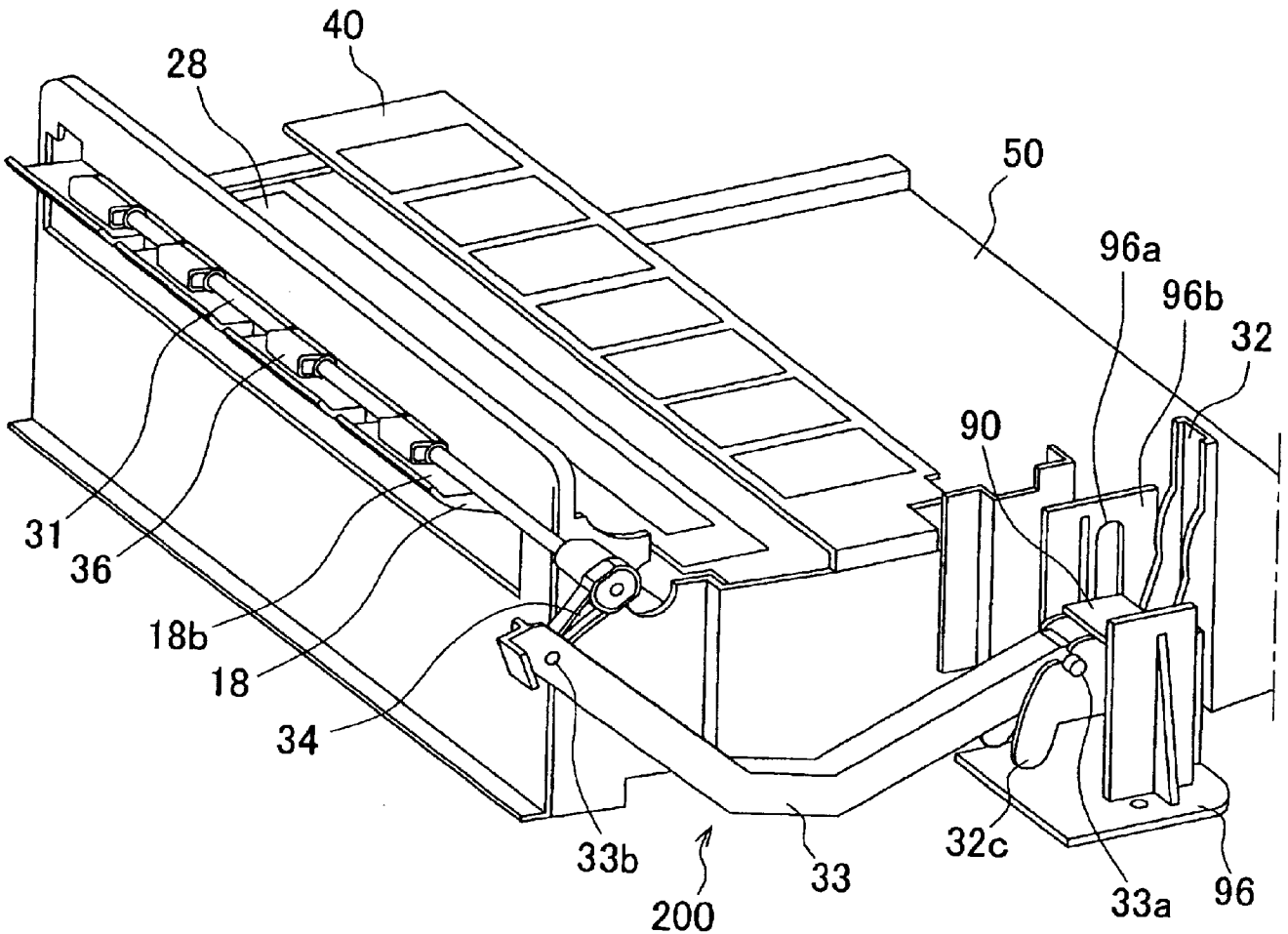
FIG. 10 is a principal part perspective view of the transfer driven roller position change link mechanism 200.
Figure 11:
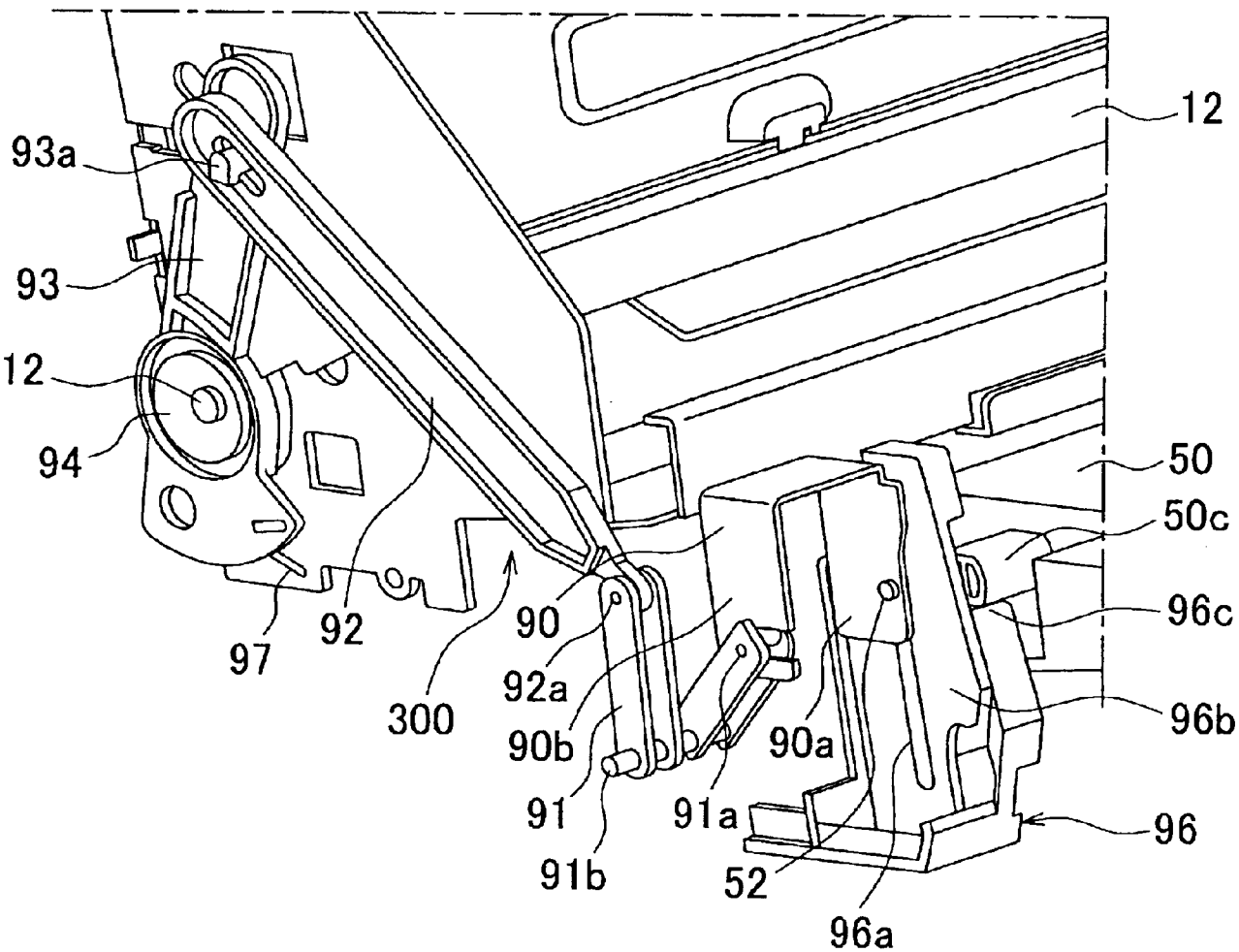
FIG. 11 is a principal part perspective view of the platen gap position change link mechanism 300.
Figure 12:
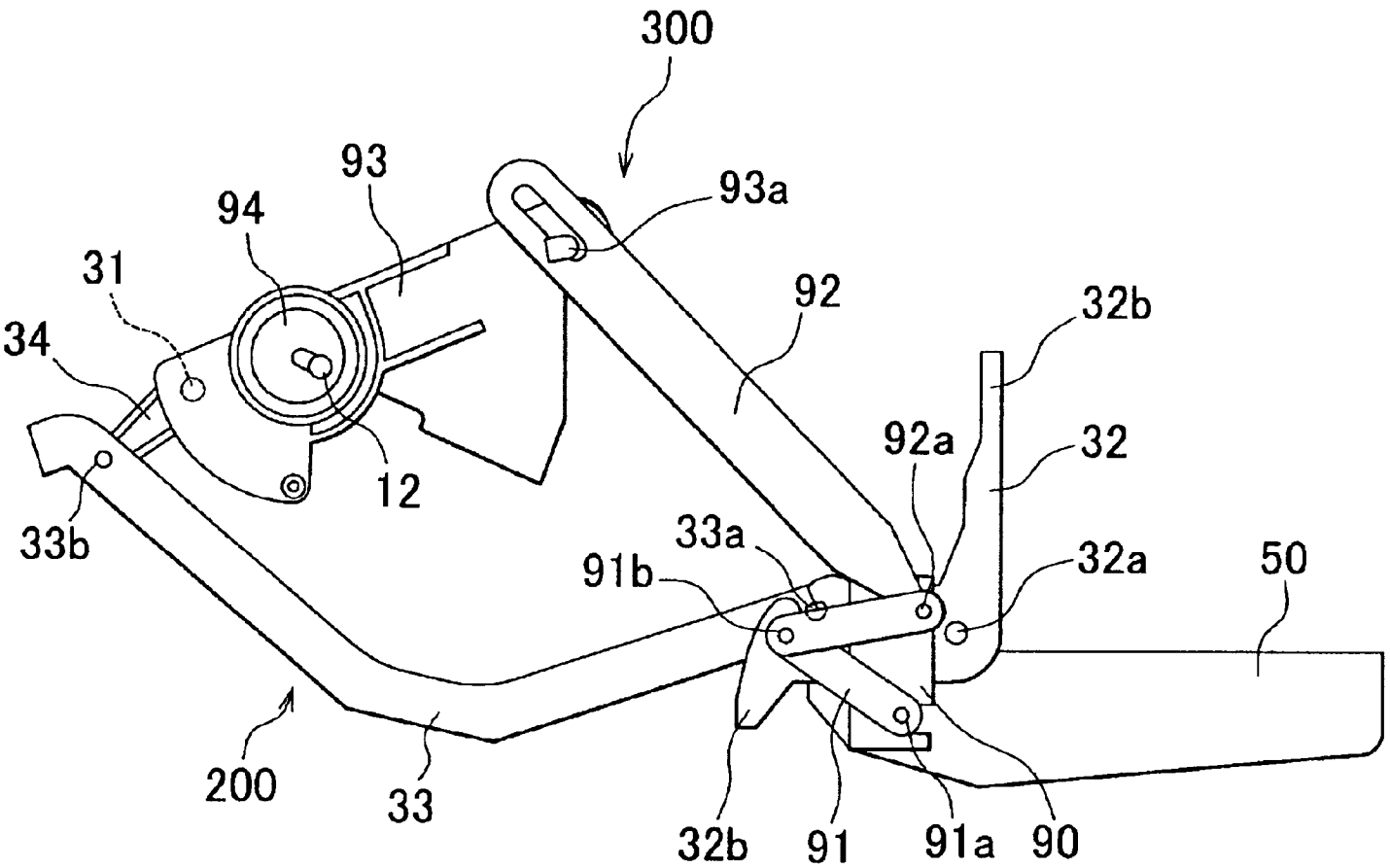
FIG. 12 to FIG. 14 are principal part side views of the transfer driven roller position change link mechanism 200 and the platen gap position change link mechanism 300.
Figure 13:
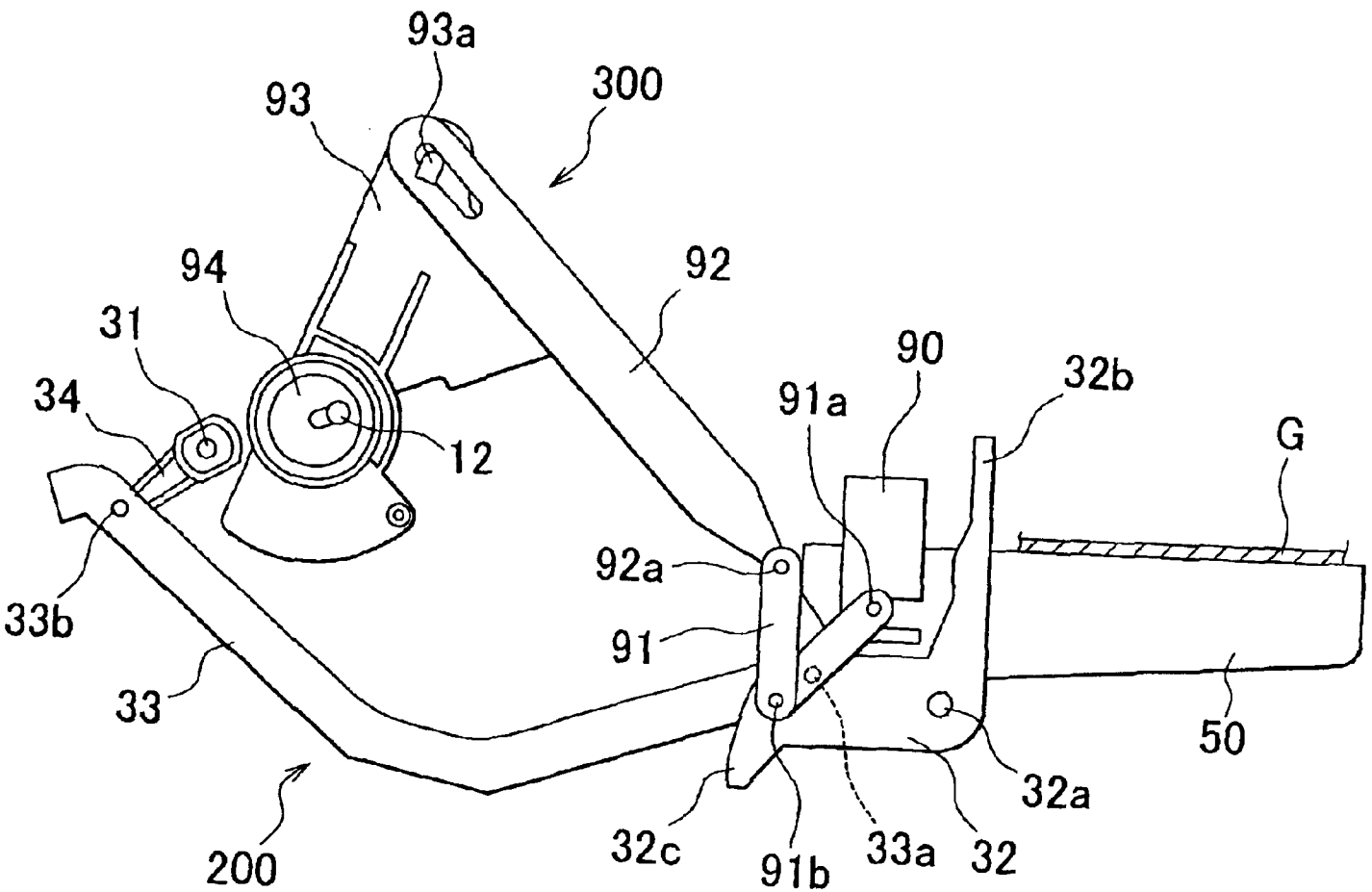
Figure 14:
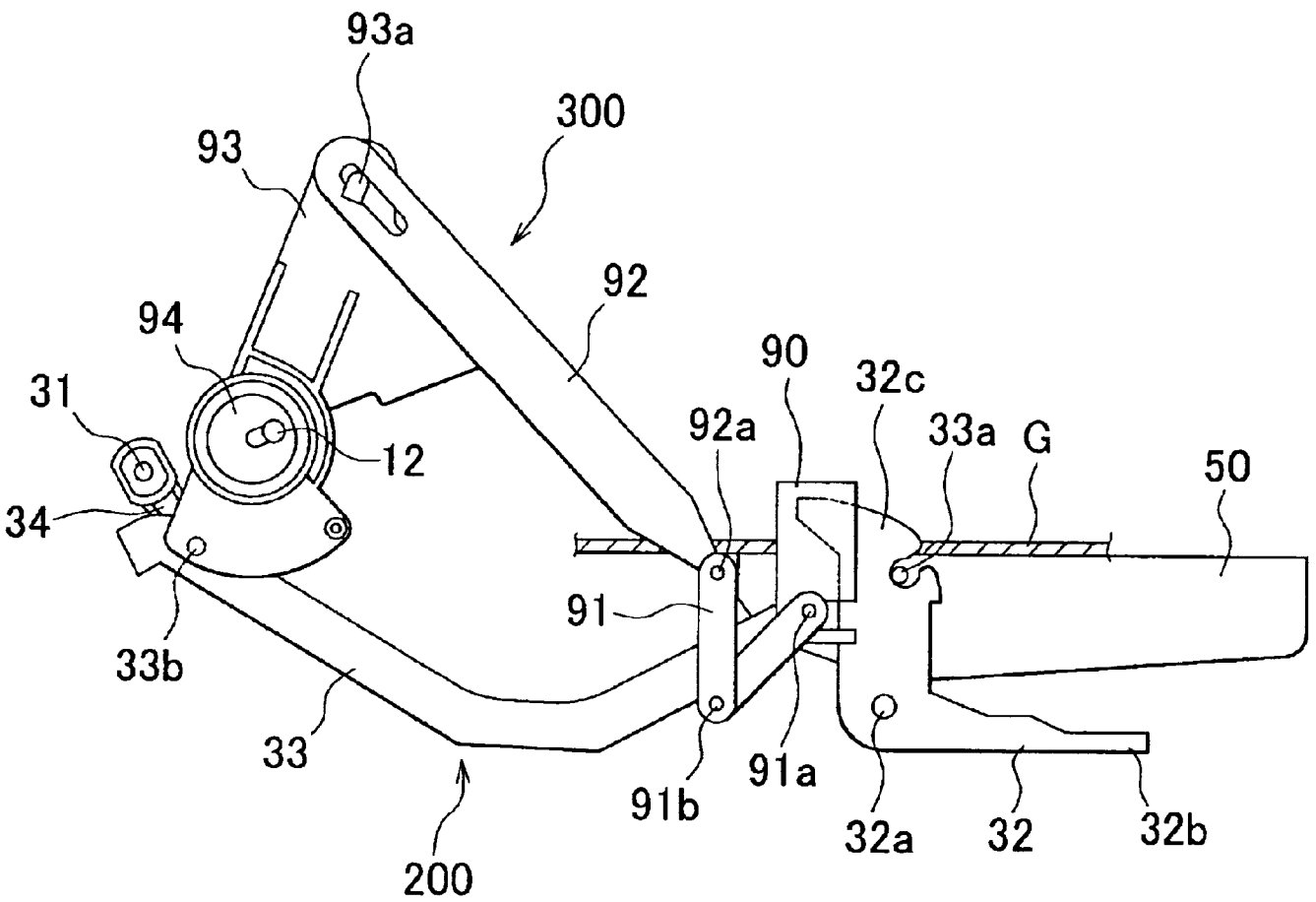
Figure 15:
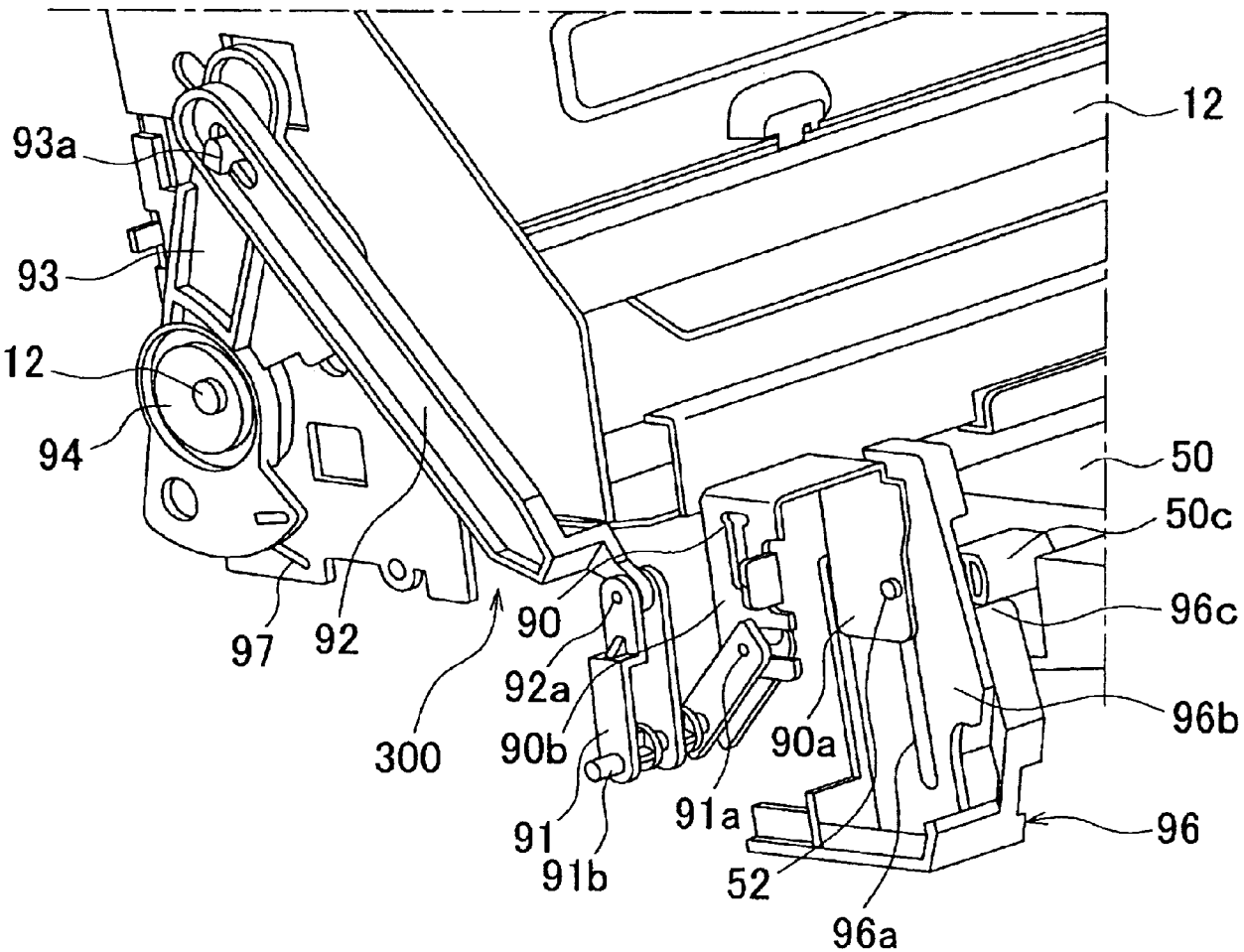
FIG. 15 depicts another example of the platen gap position change link mechanism.

Here, FIG. 9 is a principal part perspective view of the transfer driven roller position change link mechanism 200 and the platen gap position change link mechanism 300 relating to the present example, FIG. 10 is a principal part perspective view of the transfer driven roller position change link mechanism 200, FIG. 11 is a principal part perspective view of the platen gap position change link mechanism 300 and FIG. 12 to FIG. 14 are principal part side views of the transfer driven roller position change link mechanism 200 and the platen gap position change link mechanism 300.

Moreover, in regard to the position of the recording medium stacker 50, FIG. 9, FIG. 10 and FIG. 12 depict the second position, and FIG. 11, FIG. 13 and FIG. 14 depicts the first position. Further, the transfer driven roller position change link mechanism 200 and the platen gap position change link mechanism 300 to be described here are provided at the opposite side of the above paper discharging frame position change link mechanism 100, besides at the left side of the recording medium stacker 50 when viewed from the front of the apparatus. That is, these FIG. 9 to FIG. 14 show the printer 1 viewed from the left side.

The printer 1 has the transfer driven roller position change link mechanism 200, wherein the transfer driven roller holder 18 is swung by operating an operation lever 23 as an operation unit so that the transfer driven roller 19*b* is separated from the transfer driving roller 19*a*, and the platen gap position change link mechanism 300, wherein the position of a carriage guide shaft 12 is changed following the position of the recording medium stacker 50 so that the platen gap (PG) meaning the distance between the recording head 13 mounted on the carriage 10 supported by the carriage guide shaft 12 and the platen 28 is adjusted.

First, the transfer driven roller position change link mechanism 200 will be described referring to FIG. 9 and FIG. 10. Here, FIG. 9 is a principal part perspective view of the printer 1 depicting the transfer driven roller position change link mechanism 200 and the platen gap position change link mechanism 300, and FIG. 10 is a principal part perspective view of the printer 1 viewed at an angle different to that in FIG. 9, depicting the transfer driven roller position change link mechanism 200 omitting the platen gap position change link mechanism 300.

The transfer driven roller position change link mechanism 200 has the operation lever 32, a third transferring part 33 and a fourth transferring part 34, which are provided at the front left of the apparatus (the left of the recording medium stacker 50) as an operation unit.

The operation lever 32 is designed to be capable of swinging approximately 90 degrees around a swing shaft 32*a*. The third transferring part 33 in the shape of a rod is installed at the operation lever 32 via an engaging part 33*a* formed at a body part 32*c* at the upstream of the operation lever 32. Moreover, the fourth transferring part 34 is installed at the third transferring part via an engaging part 33*b*, and a cam rotating shaft 31 is fastened and installed at the fourth transferring part 34. Further, since the operation lever 32 is urged slightly toward the upstream (to the apparatus body) by an urging member (e.g. a rubber member) which is not shown, its unnecessary swing is controlled.

Owing to the structure, as the operation lever 32 is operated to rotate the cam rotating shaft 31 via the third and fourth transfer ring members 33 and 34 and the transfer driven roller holder 18 is swung, the transfer driven roller 19*b* can be separated from the transfer driving roller 19*a*.

That is, when an operation part 32*b* of the operation lever 32 is rotated toward the upstream (in the direction away from the apparatus), the transfer driven roller 19*b* can be in contact with the transfer driving roller 19*a* as the transfer driven roller holder 18 is in the contact state by the urging means described above (cf. FIG. 1). Moreover, when an operation part 32*b* of the operation lever 32 is rotated toward the downstream (in the direction toward the apparatus), the transfer driven roller 19*b* can be separated from the transfer driving roller 19*a* as the transfer driven roller holder 18 is swung against a force to be in the separation state (cf. FIG. 2).

Moreover, the body part 32*c* is provided at a space part formed inside an operation member 90 to be described later. Owing to the structure, in case the recording medium stacker 50 is in the second position, the operation lever 32 is controlled not to operated so that the operation of the transfer driven roller position change link mechanism 200 is controlled to maintain the transfer driven roller holder 18 to be in the contact state. And, only in case the operation member 90 is moved upwards accompanying that the recording medium stacker 50 is in the first position, it is possible to operate the operation lever 32.

Next, the platen gap position change link mechanism 300 will be described referring to FIG. 9 and FIG. 11. Here, FIG. 11 is a principal part perspective view of the printer 1, showing the platen gap position change link mechanism 300 and omitting the transfer driven roller position change link mechanism 200 and a part of a guide cover 96.

The platen gap position change link mechanism 300 has the operation member 90 for rotatably supporting the engaging shaft 52 projecting from the side of the recording medium stacker 50, a first transferring part 91, a second transferring part 92 and a rotation body 93.

The operation member 90 has a first side part 90*a* at the recording medium stacker 50 and a second side part 90*b* at the outside, which are provided to be parallel to each other, and it is provided to be the U shape swollen upwards viewed at the downstream. Moreover, the engaging shaft 52 is rotatably supported at the first side part 90*a*, and the operation member 90 is designed to be capable of moving up and down against the apparatus following (accompanying) the position change of the recording medium stacker 50. In addition, a movement path 96*a*, which is long in the up-and-down direction to the apparatus, for the engaging shaft 52 is formed at a wall part 96*b* of the guide cover 96, which is shown in FIG. 11 while a part of it is omitted, provided between the recording medium stacker 50 and the operation member 90. Moreover, the operation member 90 is controlled not to move needlessly in the back-and-forth direction and the up-and-down direction to the apparatus along the inner surface of the guide cover 96.

And, the transferring part 91 in the shape of V viewed from the side is installed at the second side part 90 of the operation member 90 to be capable of swing around a swing point 91*b* via an engaging part 91*a*. Further, the swing point 91*b* is rotatably supported to be capable of swing against the guide cover 96. And, the second transferring part 92 in the shape of a line is installed at the first transferring part 91 via an engaging part 92*a*, and further the rotation body 93 is installed at the second transferring part 92 via an engaging part 93*a* having predetermined play. The rotation body 93 is designed to support the carriage guiding shaft 12 at the position out of its rotation center via the eccentric push part 94.

Owing to the structure, the position of the recording medium stacker 50 is changed to rotate the rotation body 93 via the operation 90, the first transferring part 91 and the second transferring part 92 so that the position of the carriage guiding shaft 12 supported at the position out of the rotation center of the rotation body 93 can be changed in the up-and-down direction to the apparatus. Owing to this, PG can be adjusted.

That is, in case the recording medium stacker 50 is in the second position, the platen gap is adjusted to the PG normal in which the carriage 10 is in the position N by changing the position of the carriage guiding shaft 12 right downwards (i.e. in the direction close to the platen 28), and in case the recording medium stacker 50 is in the first position, the platen gap is adjusted to the PG ++ in which the carriage 10 is in the position ++ by changing the position of the carriage guiding shaft 12 right upwards (i.e. in the direction away from the platen 28).

As the platen gap is adjusted corresponding to the recording medium in this way, the distance between the recording surface of the recording medium and the recording head 13 (the paper gap) can be adjusted properly, and the good print quality can be obtained. And, as the PG ++ can be set in case of the hard recording medium G such as CD-R having thickness, the hard recording medium G can be prevented from being in the contact with the recording head 13.

Moreover, since a sensor (not shown) is provided near the rotation body 93, the position of the carriage 10 can be recognized by detecting the rotation of the rotation body 93.

Here, the operation of the transfer driven roller position change link mechanism 200 and the platen gap position change link mechanism 300 will be described referring to FIG. 12 to FIG. 14. Here, FIG. 12 to FIG. 14 show the transfer driven roller position change link mechanism 200, the platen gap position change link mechanism 300 and the recording medium stacker 50. Moreover, for the sake of description, it will be described on the basis of the recording medium stacker 50, in regard to the case the position of the recording medium stacker 50 is changed from the second position (cf. FIG. 12) to the first position (cf. FIG. 13 and FIG. 14), properly referring to FIG. 1 and FIG. 2 in regard to the overall state of the printer 1.

In case the recording medium stacker 50 is in the second position as shown in FIG. 12, the carriage guiding shaft 12 is maintained to allow the carriage 10 to be in the position N, and the transfer driven roller holder 18 is maintained to be in the contact state (FIG. 1). Moreover, the paper discharging frame 40 is in the contact state.

Further, the operation lever 32 is controlled by the operation member 90 not to be operated. That is, since the operation 90 controls the body part 32*c* of the operation lever 32 downwards, the operation lever 32 is controlled not to rotate. Therefore, the transfer driven roller position change link mechanism 200 cannot be operated with the operation lever 32 so that the transfer driven roller holder 18 is maintained in the contact state in which the transfer driven roller 19*b* is in contact with the transfer driving roller 19*a* in case the recording medium stacker 50 is in the second position.

At this state, the recording medium stacker 50, first, is rotated around the engaging shafts 52 toward the apparatus body (in the counter-clockwise direction in FIG. 12) to be approximately vertical, and then is lifted upwards. Owing to this, the operation member 90 is also lifted upwards following the movement, and the first transferring part 91 is swung around the swing point 91 toward the upstream (in the counter-clockwise direction in FIG. 12). The rotation body 93 is rotated toward the upstream (in the counter-clockwise direction in FIG. 12) via the second transferring part 92 following the movement of the first transferring part 91, the position of the carriage guiding shaft 12 is changed upwards (i.e. in the direction where the carriage 10 is separated from the platen 28) via the eccentric push part 94 at the position out of the rotation center of the rotation body 93, and the position of the carriage 10 is changed to the position ++. And, the state shown in FIG. 13 can be realized by rotating the recording medium stacker 50 toward the downstream.

In this way, as the position of the recording medium stacker 50 is changed from the second position to the first position, the position of the carriage 10 is changed from the position N to the position ++, and the platen gap can be changed from the PG normal to the PG ++. That is, the platen gap can be set to the PG ++ in case the recording medium stacker 50 is in the first position. Moreover, as described above, the paper discharging frame 40 comes into the separation state as the recording medium stacker 50 comes into the first position.

In addition, the first position of the recording medium stacker 50 is maintained as the engaging shaft 52 is positioned at the top of the movement path 96*a* formed at the guide cover 96 and besides the rotation body 93 is urged in the counter-clockwise direction by a twisted spring 97. And, the recording medium stacker 50 in the first position is maintained to be approximately horizontal as an engaging part 50*c* formed at the recording medium stacker 50 as one unit engages with an engaged part 96 formed at guide cover 96 as one unit.

Further, as shown in FIG. 13, the control to the operation lever 32 is removed as the operation member 90 is lifted following the movement of the recording medium stacker 50. That is, the operation lever 32 is designed to be operated only when the recording medium stacker 50 is in the first position.

Next, it will be described that the operation lever 32 is operated to allow the transfer driven roller position change link mechanism 200 to work.

As shown in FIG. 13, at the state in which the recording medium stacker 50 is in the first position, the operation lever 32 is swung around the swing shaft 32*a* toward the downstream, namely in the direction away from the apparatus (in the clockwise direction in FIG. 13). Owing to this, the fourth transferring part 34 is rotated around the cam rotating shaft 31 via the third transferring part 33, which causes the state shown in FIG. 14. As the cam rotating shaft 31 is rotated, the cam member 36 comes in contact with the cam follower part 18*b* as described above, the transfer driven roller holder 18 is urged to be swung and the position of the transfer driven roller holder 18 is changed to the separation state. In this way, the transfer driven roller holder 19*b* can be separated from the transfer driving roller 19*a* (cf. FIG. 2).

Moreover, as shown in FIG. 14, in case the state in which the recording medium stacker 50 is in the first position and the operation lever 32 is swung in the direction away from the apparatus (i.e. in the state in which the transfer driven roller holder 18 is separated) is changed to the state in which the material stacker 50 is in the second position, the change to the state shown in FIG. 12 is done at once, and the operation lever 32 is forced to be swung toward the apparatus body following the descent of the operation member 90 to change the position of the transfer driven roller holder 18 to be in the contact state via the paper discharging frame position change link mechanism 200 while the carriage 10 is in the position N via the platen gap position change link mechanism 300 to set the platen gap to be the PG normal.

As described above, the printer 1 is designed to be capable of changing the states of the paper discharging frame 40, the platen gap and the transfer driven roller holder 18 following the position of the recording medium stacker 50.

That is, in case the recording medium stacker 50 is in the second position, as shown in FIG. 1, the paper discharging frame 40 is in the contact state and the carriage 10 is positioned at the position N so that the platen gap is set to the PG normal and the transfer driven roller holder 18 is in the contact state.

And, in case the recording medium stacker 50 is in the first position, as shown in FIG. 2, the paper discharging frame 40 is in the separation state and the carriage 10 is positioned at the position ++ so that the platen gap is set to the PG ++ and the transfer driven roller holder 18 is in the separation state.

Therefore, as a user operates the recording medium stacker 50 and the operation lever 32, the paper discharging frame 40, the platen gap and the transfer driven roller holder 18 can be set to the optimum state, and the benefit in operation is extremely great.

Next, another example of the platen gap position change link mechanism 300 will be described referring to FIG. 5. Moreover, parts having the same functions as those in FIG. 11 are given the same symbols, and description about these parts will be omitted.

In the present example, as shown in drawing, an operation member 90, the shapes of a transferring member 91 and a second transferring member 92 are different from those of the previous example (FIG. 11). Owing to these shapes, the adjustment to the parts, which are not shown, becomes smooth, and the platen gap position change link mechanism 300 can work more efficiently.

Although the present invention has been described by way of exemplary embodiments, it should be understood that those skilled in the art might make many changes and substitutions without departing from the spirit and the scope of the present invention, which is defined only by the appended claims.

What is claimed is:

1. A recording apparatus comprising:

a recording medium feeding mechanism provided at an upstream of a recording medium transfer path for feeding a recording medium, which is stacked and held on a slant, to a downstream one at a time;

a recording head provided at a downstream of said recording medium feeding apparatus for performing recording on the recording medium;

a paper discharging roller set provided at a downstream of said recording head, comprising a paper discharging driven roller provided on a recording side of the recording medium and a paper discharge driving roller provided on non-recording side of the recording medium, for discharging the recording medium on which recording is performed;

a paper discharging frame for holding said paper discharging driven roller, said frame being operated to change between a contact state where said paper discharging driven roller is in contact with said paper discharge driving roller and a separation state where said paper discharging driven roller is separated from said paper discharge driving roller;

a side frame provided at both sides of said paper discharging frame;

a recording medium stacker operated to change between a first position where a hard recording medium is fed from a recording medium stacking surface, which is substantially horizontal, directly to said recording head and discharged in the same direction, a feeding and/or discharging path being straight, and a second position in which recording is performed on a recording medium, which is fed by said recording medium feeding apparatus, said medium which has been discharged being stacked;

a link mechanism for changing a position of said paper discharging frame between said contact and separation states by changing a position of said recording medium stacker, said link mechanism allowing said paper discharging frame to be in said contact state by setting said recording medium stacker to be in said second position, and allowing said paper discharging frame to be in said separation state by setting said recording medium stacker to be in said first position.

2. A recording apparatus as claimed in claim 1, wherein a position of said paper discharging frame is changed between said contact and separation states, while a posture of said paper discharging frame in said contact state is maintained.

3. A recording apparatus as claimed in claim 1, wherein said paper discharging frame is urged toward said contact state by an urging means.

4. A recording apparatus as claimed in claim 1, wherein said link mechanism comprises:

a release lever sub engaged with said recording medium stacker to be capable of moving up and down against said apparatus, following a position change of said recording medium stacker;

a release lever provided at a rotating shaft to be capable of rotating around said rotating shaft by sliding a sliding groove formed at said release lever sub; and a link frame engaged with said release lever via said rotating shaft to be incapable of rotating against said release lever, said link frame rotatably engaging with said paper discharging frame.

5. A recording apparatus as claimed in claim 4, wherein a cross-section of said rotating shaft is a rectangle shape.

6. A recording apparatus as claimed in claim 1, wherein an engaging projection is formed at said side frame, for determining a position of said paper discharging frame in the contact state by engaging with said paper discharging frame.

7. A recording apparatus as claimed in claim 1, wherein a guide slant is formed at said side frame for guiding a position change of said paper discharging frame between said contact and separation states, while maintaining a posture of said paper discharging frame in said contact state, in case said separation state is slanting upwards to said contact state.

8. A recording apparatus as claimed in claim 1, wherein a guide slant is formed at said side frame for guiding a position change of said paper discharging frame in order that an upstream of said paper discharging frame is separated more upwards than a downstream of said paper discharging frame, in case said separation state is slanting upwards to said contact state.

9. A recording apparatus comprising:

a recording medium feeding mechanism for feeding a recording medium to a downstream by one at a time;

a recording head provided at a downstream of said recording medium feeding apparatus for performing recording on a recording medium;

a paper discharging frame provided at a downstream of said recording medium feeding apparatus, said paper discharging frame being operated to change between an approach state positioned right above a recording medium transfer path and a separation state positioned more upwards than said approach state;

a paper discharging driven roller installed in said paper discharging frame, projecting downwards;

a paper discharge driving roller provided to a bottom of said paper discharging frame independently for discharging a material on which recording is performed by rotating;

a side frame provided at both sides of said paper discharging frame;

a recording medium stacker capable of being changed to a first position in which a hard recording medium is fed from a recording medium stacking surface, which is substantially horizontal, straight to said recording head and discharged in the same direction, a feeding and/or discharging path being straight, and a second position, lower than said first position, in which recording is performed on a recording medium, which can be fed by said recording medium feeding apparatus, said material which has been discharged being stacked; and a link mechanism for changing a position of said paper discharging frame between said approach and separation states by changing a position of said recording medium stacker, said link mechanism allowing said paper discharging driven roller to approach said recording medium transfer path via said paper discharging frame by setting said recording medium stacker to be in said second position, and allowing said paper discharging driven roller to be separated from said recording medium transfer path via said paper discharging frame by setting said recording medium stacker to be in said first position.

10. A recording apparatus comprising:

a recording medium feeding mechanism for feeding a recording medium including a hard recording medium and a non-hard recording medium in a recording medium transfer oath one at a time;

a recording head provided at a downstream of said recording medium feeding apparatus for performing recording on the recording medium at a record performing area;

a discharging roller set provided in the medium transfer path at a downstream of said recording head, comprising a discharging driven roller provided to a recording side of the recording medium and a discharge driving roller provided to a non-recording side of a recording medium, for discharging the medium on which recording is performed;

a recording medium stacker having a recording medium stacking surface operated to change between a first position where said discharging driven roller is separated from the recording medium transfer path, said first position constituting a straight medium feeding and/or discharging path extending between said recording medium stacking surface and said record performing area, said first position is selected when recording is performed on the hard recording medium, and the hard recording medium being transferred back and forth in said medium feeding and/or discharging path, and a second position where said discharging driven roller is in contact with said discharge driving roller and the recording medium is discharged and stacked, said second position is selected when recording is performed on the non-hard recording medium fed by said recording medium feeding mechanism; and a platen gap position change link mechanism for adjusting a distance between said recording head and a platen, following a position of said recording medium stacker, wherein said platen is provided opposite to said recording head for supporting a recording medium on a non-recording side of said material.

11. A recording apparatus comprising:

a recording medium feeding mechanism for feeding a recording medium including a hard recording medium and a non-hard recording medium in a recording medium transfer path one at a time;

a recording head provided at a downstream of said recording medium feeding apparatus for performing recording on the recording medium at a record performing area;

a discharging roller set provided in the medium transfer path at a downstream of said recording head, comprising a discharging driven roller provided to a recording side of the recording medium and a discharge driving roller provided to a non-recording side of a recording medium, for discharging the medium on which recording is performed;

a recording medium stacker having a recording medium stacking surface operated to change between a first position where said discharging driven roller is separated from the recording medium transfer path, said first position constituting a straight medium feeding and/or discharging path extending between said recording medium stacking surface and said record performing area, said first position is selected when recording is performed on the hard recording medium, and the hard recording medium being transferred back and forth in said medium feeding and/or discharging path, and a second position where said discharging driven roller is in contact with said discharge driving roller and the recording medium is discharged and stacked, said second position is selected when recording is performed on the non-hard recording medium fed by said recording medium feeding mechanism; and a transfer driven roller position change link mechanism for allowing a transfer driven roller to be in contact with a transfer driving roller in case said recording medium stacker is in said second position, and allowing said transfer driven roller to be separated from said transfer driving roller in case said recording medium stacker is in said first position, wherein said transfer driven roller is provided to a recording side of a recording medium, and said transfer driving roller is provided to a non-recording side of a recording medium, near an upstream of said recording head.

12. A liquid ejecting apparatus comprising:

a recording medium feeding mechanism provided at an upstream of a recording medium transfer path for feeding a recording medium, which is stacked and held on a slant, to a downstream one at a time;

a recording head provided at a downstream of said recording medium feeding apparatus for performing recording on the recording medium;

a paper discharging roller set provided at a downstream of said recording head, comprising a paper discharging driven roller provided on a recording side of the recording medium and a paper discharge driving roller provided on non-recording side of the recording medium, for discharging the recording medium on which recording is performed;

a paper discharging frame for holding said paper discharging driven roller, said frame being operated to change between a contact state where said paper discharging driven roller is in contact with said paper discharge driving roller and a separation state where said paper discharging driven roller is separated from said paper discharge driving roller;

a side frame provided at both sides of said paper discharging frame;

a recording medium stacker operated to change between a first position where a hard recording medium is fed from a recording medium stacking surface, which is substantially horizontal, directly to said recording head and discharged in the same direction, a feeding and/or discharging path being straight, and a second position in which recording is performed on a recording medium, which is fed by said recording medium feeding apparatus, said medium which has been discharged being stacked;

a link mechanism for changing a position of said paper discharging frame between said contact and separation states by changing a position of said recording medium stacker, said link mechanism allowing said paper discharging frame to be in said contact state by setting said recording medium stacker to be in said second position, and allowing said paper discharging frame to be in said separation state by setting said recording medium stacker to be in said first position.

13. A liquid ejecting apparatus comprising:

a recording medium feeding mechanism for feeding a recording medium to a downstream by one at a time;

a recording head provided at a downstream of said recording medium feeding apparatus for performing recording on a recording medium;

a paper discharging frame provided at a downstream of said recording medium feeding apparatus, said paper discharging frame being operated to change between an approach state positioned right above a recording medium transfer path and a separation state positioned more upwards than said approach state;

a paper discharging driven roller installed in said paper discharging frame, projecting downwards;

a paper discharge driving roller provided to a bottom of said paper discharging frame independently for discharging a material on which recording is performed by rotating;

a side frame provided at both sides of said paper discharging frame;

a recording medium stacker capable of being changed to a first position in which a hard recording medium is fed from a recording medium stacking surface, which is substantially horizontal, straight to said recording head and discharged in the same direction, a feeding and/or discharging path being straight, and a second position, lower than said first position, in which recording is performed on a recording medium, which can be fed by said recording medium feeding apparatus, said material which has been discharged being stacked; and a link mechanism for changing a position of said paper discharging frame between said approach and separation states by changing a position of said recording medium stacker, said link mechanism allowing said paper discharging driven roller to approach said recording medium transfer path via said paper discharging frame by setting said recording medium stacker to be in said second position, and allowing said paper discharging driven roller to be separated from said recording medium transfer path via said paper discharging frame by setting said recording medium stacker to be in said first position.

* * * * *